US009951607B2

(12) United States Patent
Wessling et al.

(10) Patent No.: US 9,951,607 B2
(45) Date of Patent: Apr. 24, 2018

(54) SYSTEM AND METHOD FOR CHARACTERIZATION OF DOWNHOLE MEASUREMENT DATA FOR BOREHOLE STABILITY PREDICTION

(71) Applicants: Stefan Wessling, Hannover (DE); Jianyong Pei, Katy, TX (US); Roland May, Celle (DE); Andreas Hartmann, Celle (DE); Thomas Dahl, Schwuelper (DE)

(72) Inventors: Stefan Wessling, Hannover (DE); Jianyong Pei, Katy, TX (US); Roland May, Celle (DE); Andreas Hartmann, Celle (DE); Thomas Dahl, Schwuelper (DE)

(73) Assignee: BAKER HUGHES, LLC, Houston, TX (US)

( * ) Notice: Subject to any disclaimer, the term of this patent is extended or adjusted under 35 U.S.C. 154(b) by 583 days.

(21) Appl. No.: 13/755,973

(22) Filed: Jan. 31, 2013

(65) Prior Publication Data

US 2014/0214325 A1 Jul. 31, 2014

(51) Int. Cl.
*E21B 47/06* (2012.01)

(52) U.S. Cl.
CPC ..... *E21B 47/06* (2013.01)

(58) Field of Classification Search
CPC ..... E21B 47/06; G01V 9/00
See application file for complete search history.

(56) References Cited

U.S. PATENT DOCUMENTS 4,344,142 A * 8/1982 Diehr, II ..... B29C 35/0288 264/325
4,349,034 A 9/1982 Ramsey, III
4,729,382 A 3/1988 Schaffer et al.
5,343,868 A 9/1994 Kurscheidt et al.
6,151,961 A 11/2000 Huber et al.
6,378,627 B1 4/2002 Tubel et al.
9,316,054 B2 * 4/2016 Weinstock ..... E21B 7/12
2002/0010548 A1 * 1/2002 Tare et al. ..... 702/9
(Continued)

FOREIGN PATENT DOCUMENTS

WO 2005064297 A1 7/2005
WO 2008094944 A1 8/2008

OTHER PUBLICATIONS

Mody et al. Borehole-Stability Model to Couple the Mechanics and Chemistry of Driling-Fluid/Shale Interactions,Nov. 1993, p. 1093-1101.*
Wessling et al., Calibrating Fracture Gradients—An Example Demonstrating Possiblilities and Limitaions, Dec. 2009, IPTC, p. 1-12.*
Wessling et al., Automation in wellbore Stability Workflows, Mar. 2012, SPE, p. 1-12.*
(Continued)

*Primary Examiner* — John Breene
*Assistant Examiner* — Mohammad Islam
(74) *Attorney, Agent, or Firm* — Cantor Colburn LLP

(57) ABSTRACT

A method for estimating a time at which a pressure window relevant observation occurred relating to an event that occurred in an open borehole penetrating an earth formation includes: receiving with a processor a pressure window relevant observation that provides input to adjusting a pressure window for drilling fluid for drilling the borehole; and estimating with the processor a time window in which a physical parameter, a chemical parameter, or a process that caused the pressure window relevant observation to occur, the time window having a start time and an end time.

24 Claims, 23 Drawing Sheets

(56) References Cited

U.S. PATENT DOCUMENTS

| | | | | |
|---|---|---|---|---|
| 2004/0099443 | A1* | 5/2004 | Meister | E21B 44/00 175/58 |
| 2004/0211595 | A1 | 10/2004 | Pinckard et al. | |
| 2005/0257960 | A1 | 11/2005 | McGregor et al. | |
| 2007/0068704 | A1* | 3/2007 | Krueger | E21B 21/08 175/57 |
| 2008/0156484 | A1* | 7/2008 | Mese | E21B 47/10 166/250.1 |
| 2008/0257546 | A1 | 10/2008 | Cresswell et al. | |
| 2009/0218095 | A1* | 9/2009 | Gordon | E21B 33/1294 166/250.01 |
| 2009/0288881 | A1 | 11/2009 | Mullins et al. | |
| 2009/0294174 | A1 | 12/2009 | Harmer et al. | |
| 2011/0125333 | A1* | 5/2011 | Gray | E21B 21/08 700/282 |
| 2011/0153296 | A1* | 6/2011 | Sadlier et al. | 703/7 |
| 2012/0097450 | A1* | 4/2012 | Wessling | G01V 5/04 175/50 |
| 2012/0188090 | A1 | 7/2012 | Wessling et al. | |
| 2013/0066558 | A1* | 3/2013 | Wessling | G01V 11/00 702/7 |
| 2013/0299241 | A1* | 11/2013 | Alberty | E21B 47/10 175/50 |
| 2014/0077963 | A1* | 3/2014 | Dankers | E21B 41/0021 340/853.1 |

OTHER PUBLICATIONS

*Alice Corporation PTY. LTD.* v. *CLS Bank International et al.*, Supreme Court Decision, (2013).*

Pei et al. ,Constraining In-Situ Stresses at BETA by Analysis of Borehole Images and Downhole Pressure Data, 2009, IPTC 13773, pp. 1-14.*

Mody et al., Borehole-Stability Model to Couple the Mechanics and Chemistry of Drilling-Fluid/Shale Interactions, 1993, pp. 1093-1101.*

Pei, et al. "Constraining in-situ stresses at BETA by analysis of borehole images and downhole pressure date" IPTC 13773. International Petroleum Technology Conference held in Doha, Qatar, Dec. 7-9, 2009. 14 pages.

"Along-string pressure, temperature measurements hold revolutionary . . . "; Drilling Contractor; Mar./Apr. 2009; 5 pages.

Hernandez et al., "Along String Pressure and Temperature Measurements in Real Time: Early Field Use and Resultant Value"; Society of Petroleum Engineers International, SPE/IADC 119540; Mar. 17, 2009; 7 pages.

R.H. Kolb, "Two Bottom-Hose Pressure Instruments Providing Automatic Surface Recording"; Reprinted from Journal of Petroleum Technology; Feb. 1960; 4 pages.

SINTEF Petroleum Research; Drilling and wells; Apr. 2011; 2 pages.

Written Opinion of the International Searching Authority, PCTUS2014/013573; dated Apr. 17, 2014; 10 pages.

* cited by examiner

Calibration Parameters

| Breakout Interval | Orientation | Width |
|---|---|---|
| 1 | 94.1 ± 2.4 | 42.8 ± 8.6 |

| Breakout Interval | P_av | P_min | P_min While Drilling |
|---|---|---|---|
| 1 | 12.8 PPG | 12.5 PPG | 12.7 PPG |

| Breakout Interval | T_av | T_max | T_max While Drilling |
|---|---|---|---|
| 1 | NA | NA | NA |

Breakout Interval 1
Average Rock Strength (Acoustic Log): 123

SYSTEM AND METHOD FOR CHARACTERIZATION OF DOWNHOLE MEASUREMENT DATA FOR BOREHOLE STABILITY PREDICTION

BACKGROUND

Earth formations may be used for various purposes such as hydrocarbon production, geothermal production, and carbon dioxide sequestration. Typically, boreholes are drilled into the formations to provide access to them. The boreholes are drilled by a drilling rig that rotates a drill bit at the end of a drill string. Various drilling parameters are input to the drilling rig such as rotational speed, weight on bit, rate-of-penetration (ROP), flow rate or fluid type in order to drill a borehole while preventing borehole breakouts and fractures from occurring. Borehole breakouts and fractures are indications that the specific drilling parameters may have caused the borehole wall to be over-stressed. Hence, it would be appreciated in the drilling industry if the drilling parameters could be selected to prevent over-stressing of a borehole while it is being drilled.

BRIEF SUMMARY

Disclosed is a method for estimating a time at which a pressure window relevant observation occurred relating to an event that occurred in an open borehole penetrating an earth formation. The method includes receiving with a processor a pressure window relevant observation that provides input to adjusting a pressure window for drilling fluid for drilling the borehole. The method further includes estimating with the processor a time window in which at least one selection from a group consisting of a physical parameter, a chemical parameter, and a process that caused the pressure window relevant observation to occur, the time window having a start time and an end time.

Also disclosed is an apparatus for estimating a time at which a pressure window relevant observation occurred relating to an event that occurred in an open borehole penetrating an earth formation. The apparatus includes a processor, which is configured to receive a pressure window relevant observation that provides input to adjusting a pressure window for drilling fluid for drilling the borehole, and estimate a time window in which at least one selection from a group consisting of a physical parameter, a chemical parameter, and a process that caused the pressure window relevant observation to occur, the time window having a start time and an end time.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
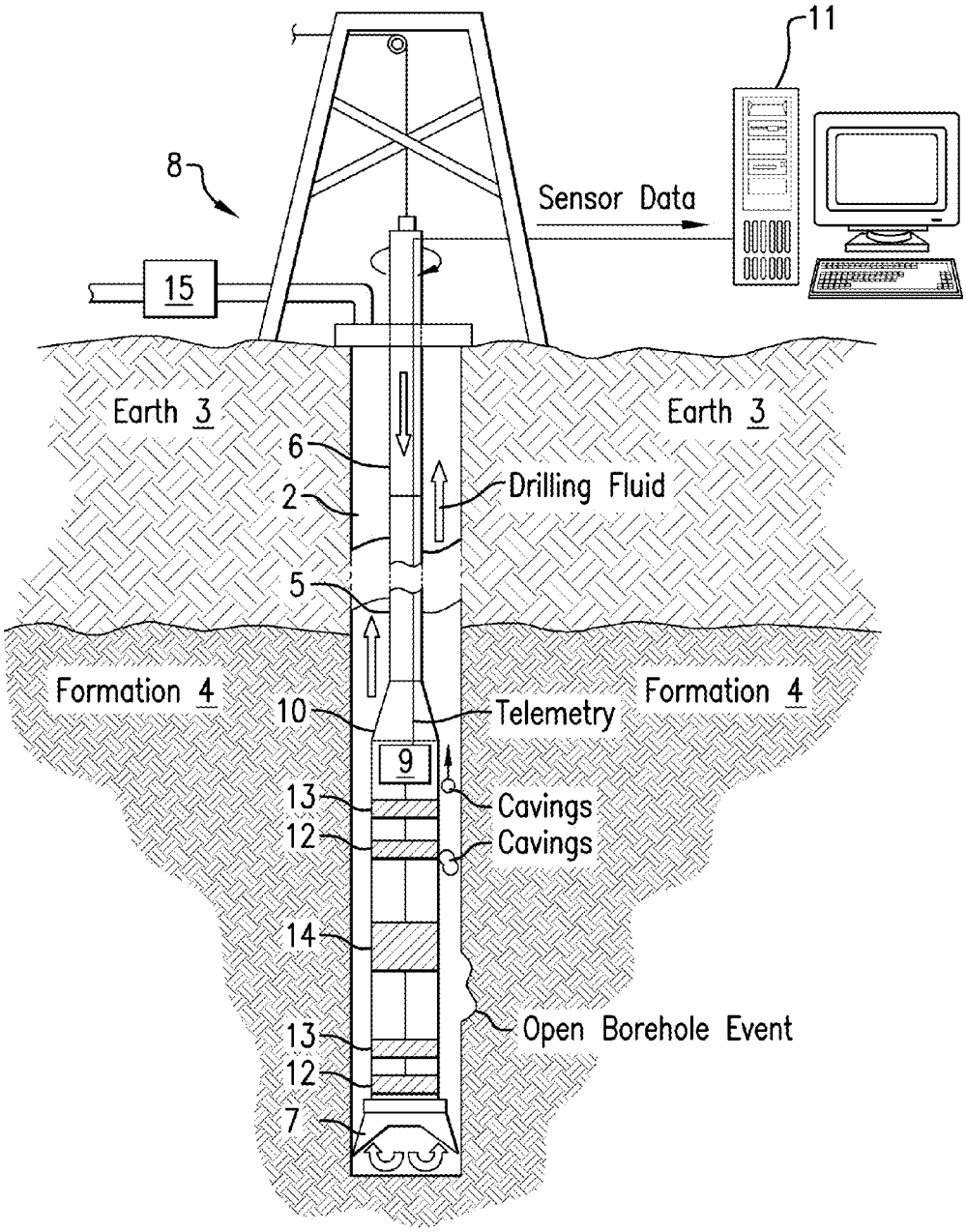
FIG. 1 illustrates a cross-sectional view of an exemplary embodiment of a downhole tool disposed in a borehole penetrating the earth.

A detailed description of one or more embodiments of the disclosed apparatus and method presented herein by way of exemplification and not limitation with reference to the Figures.

Disclosed are method and apparatus for drilling a borehole penetrating an earth formation. More specifically, a method and system are disclosed for automatically updating a pressure window for safe drilling by an integrated analysis of drill string or drilling operations and wellbore stability relevant events in the environment of a borehole or at the surface. The method and system includes identifying one or more dysfunctions during a drill string or drilling operation and assigning physical parameters such as temperature and or pressure to the dysfunctions. Physical parameters may be derived from measurements downhole or from physical models if direct measurements are not available or if locations of measurements are not the same as locations of interest (e.g., location of dysfunction), so that an interpolation or extrapolation of the physical properties is necessary.

Drilling operations or drill string operations include any movements or activities that are conducted when a borehole is created. More specifically, drilling or drill string operations include on-bottom drilling, tripping out of the hole, tripping into the hole, coring, re-logging, any kind of reaming or under-reaming, setting a casing, running a wireline operation, or setting a liner while drilling. Also, activities where the drill string is not altered may belong to a drilling operation, such as waiting on weather, waiting on maintenance, etc. In addition, unintentional drill string movements such as rig heave for offshore rigs are considered as a drill string operation. It is well understood that any of the above mentioned operations or activities may be conducted under flow-on conditions, where drilling fluid is circulated through the drill string and back through the annulus to the surface. Reverse circulation down the annulus and back to the surface through the drill string is also considered a flow-on condition. Likewise, the above mentioned drilling operations may be conducted under flow-off condition, where no drilling fluid is circulated. Also, it is well understood that the above mentioned drilling or drill string operations may be conducted while rotating the drill string (rotary mode) or while not rotating the drill string (sliding more).

During a drilling or drill string operation, the drill string, the bottom-hole assembly, the bit, the drilling fluid or any other device or component of the drilling system may behave in a way that is not desirable or harmful for the drilling or drill string operation, which is hereafter referred to as a drilling or drill string dysfunction. A drilling or drill string dysfunction includes vibrations of any kind of the drill string or the bottom hole assembly, the drill pipe, drill string or bottom hole assembly getting stuck when trying to pull out of hole or trying to run into the hole, swab or surge effects due to fast movements of the drill string, pack-offs due to inefficient hole cleaning Those drilling dysfunctions may be automatically detected by analysis and interpretation of downhole measurements-while-drilling (MWD) data, logging-while-drilling (LWD) data, and of surface logging data such as the surface-weight-on-bit, the flow back pressure, the pump pressure, etc.

Drilling or drill string operational dysfunctions are oftentimes causing instable wellbore conditions which can result in drilling operational challenges including the abandonment of a wellbore in the worst case. Therefore, in addition to automatically detecting drilling or drill string dysfunctions, events, features or incidents, which are indications for an instable wellbore, may also be automatically detected. Among others, such features include borehole breakouts, washouts or other unintentional hole enlargements detected by LWD images of the borehole wall or detected by LWD caliper logs, cavings detected at the mud shaker at the surface, drilling-induced tensile fractures detected by LWD image sensors, losses of drilling mud into the formation, or a fluid entry into the formation termed a kick.

Wellbore stability relevant events, features or incidents can be used to update the pressure window for safe drilling operations if the downhole physical properties such as the downhole annular pressure and temperature conditions are known. What is usually not precisely known is the exact time at which a wellbore stability relevant incident or feature was created because either the downhole LWD sensors pass the feature at some time after the bit or because the feature, (e.g., the cavings) need to be transported to the surface by the drilling mud before they can be detected. Therefore, an integrated analysis of drilling dysfunctions and wellbore stability events is desirable.

A sensor detects a location of a borehole abnormality and other sensors measure physical properties such as pressure and temperature in the vicinity of the abnormalities. Alternatively a plurality of sensors measure physical properties and analyze those measurements to detect borehole abnormalities. A mathematical geo-mechanical model of the formation is updated or calibrated using estimates of the properties at the abnormality location using the measurements. Because the exact properties at the abnormality may not be known, the properties may be estimated with a statistical uncertainty. The term "geomechanical model" relates to a mathematical model of the earth formation, which calculates mechanical stresses in an earth formation at one or more depths using properties measured or identified by one or more downhole tools. Parameters from laboratory investigations may also be used if direct measurements of formation properties are not possible or not available. In addition, information, parameters and data may be used from offsite wells for the geo-mechanical model. The geomechanical model may include one or more equations for calculating the mechanical stresses and the compressive and tensile failure of the formation around the borehole. By inputting the latest and most accurate logged measurements, the geomechanical model can provide the most accurate estimates of the stresses and formation rock failure. Further, drilling parameters can be selected such that drilling operations do not result in pressures and temperatures that cause the formation stresses to be exceeded. The model, in addition, may incorporate pressure and temperature data from previously drilled boreholes that may or may not have a borehole abnormality. For example, if in a previously drilled borehole a certain combination of pressure and temperature is associated with a borehole abnormality, then that information may be incorporated into the model as a combination that should be avoided to prevent the creation of a borehole abnormality in a currently drilled borehole.

Figure 2:
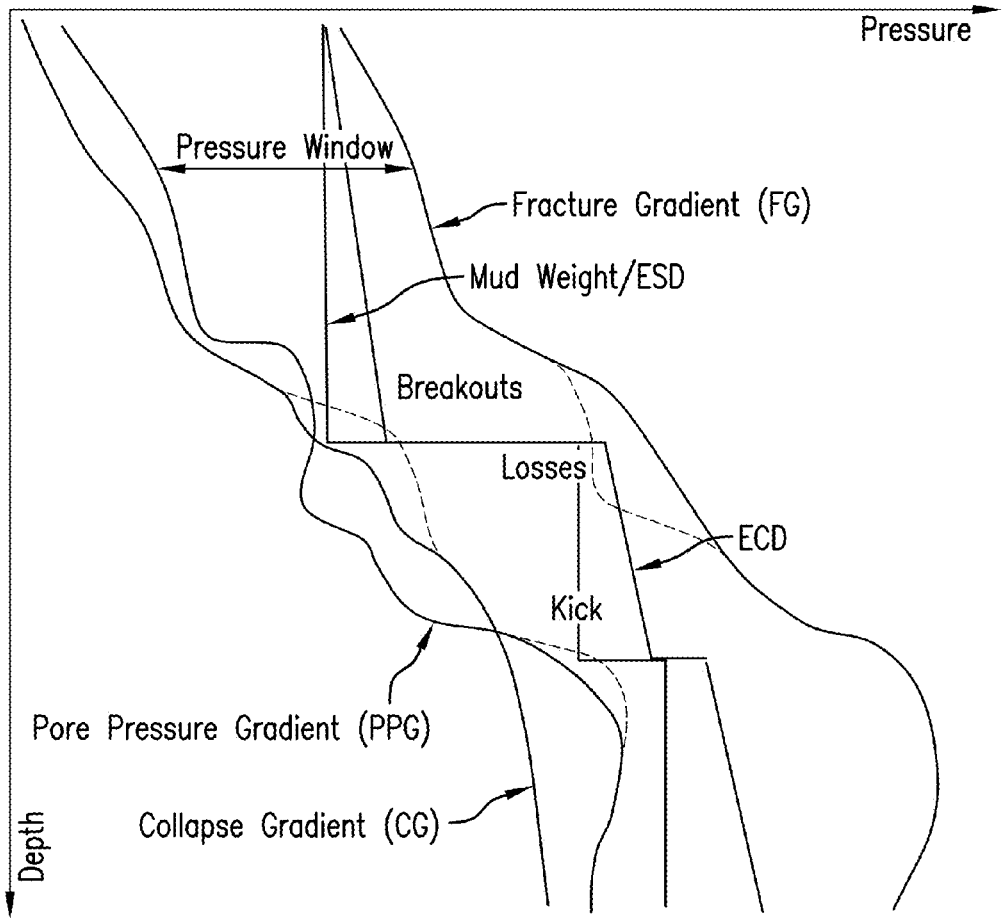
FIG. 2 illustrates an exemplary pressure window for drilling operations.

The drilling pressure window is depicted in FIG. 2 and is the acceptable range of pressures established in the borehole annulus along the open hole section. Factors that are part of establishing the drilling pressure include drilling fluid weight (or mud weight) and flow rate of the drilling fluid. In one or more embodiments, the flow rate may be determined by the speed or output pressure of the drilling fluid pump and/or by valve position of a valve through which drilling fluid exits the borehole. The upper bound of the pressure window is the fracture gradient. There are two lower bounds of the pressure window. One lower bound is the pore pressure gradient while the other lower bound is the collapse gradient. The pressure window is below the upper bound and above the higher of the two lower bounds. In FIG. 2, the term "ESD" is the Equivalent Static Density and the term "ECD" is the Equivalent Circulating Density. Both are measures of the annular pressure in the borehole. "Static" relates to when no drilling fluid is circulating and "dynamic" relates to when drilling fluid circulates through the borehole. The dynamic value is higher than the static value due to circulation effects. In the drilling industry, the equivalent density is used instead of the pressure because a density value is easier to compare with the density of the drilling fluid.

Caliper (or borehole diameter) logs or images of the borehole wall are used to detect abnormalities (also referred to as features) such as breakouts and drilling-induced tensile fractures. These features develop due to excessive re-distributed stresses around the wellbore as a result of excessive annulus pressure and/or temperature. The amount of stress re-distribution depends on the in-situ prevailing Earth stresses (orientation and magnitude), the formation pore pressure, the offload applied by the drilling fluid pressure to the wellbore wall and the temperature difference between the annulus and the formation. Other types of wellbore stability relevant features are washouts in brittle shales or, more general, in fractured rock. Washouts are fully circumferential hole enlargements caused by drilling fluid penetrating into the fractured matrix and thereby decreasing the effective stress around the wellbore which ultimately leads to sloughing of formation material into the annulus of the borehole. Both borehole breakouts and washouts by sloughing formations create cavings which are transported by the drilling fluid to the surface. Cavings are larger pieces of rock (compared to cuttings which develop from the rock-bit interaction) and the shape of the cavings provides information about the failure mechanism that is prevailing in the downhole formation.

The transport of cavings from the downhole formation to the surface by the drilling fluid can be estimated when fluid density and rheology as well as the operating conditions of the drilling process like flow rate and drill string rotary speed are known. Including the operation process history in the transport modeling further increases the accuracy of the prediction. Therefore, whenever cavings are detected at the surface, an approximate time at which the cavings have been created may be inferred, although an uncertainty has to be assigned to the estimated time. The uncertainty originates from the unknown location of the rock failure and from the accuracy of estimating the transport properties of the drilling mud. Of course, the uncertainty of the cavings creation time reduces with more accurate transportation models and failure location measurements.

Also transported with the drilling fluid is gas which escapes from the formation into the borehole annulus if the formation pore pressure is larger than the pressure of the drilling fluid. Detection of gas by sensors installed at the surface of a rig is therefore another means to calibrate the pressure window. Upon the detection of gas at the surface, the origin of that gas may be inferred from an appropriate model for the transport and flow of gas from a downhole formation to the surface, and physical parameter assigned to the gas readings.

Knowledge of the annular pressure and temperature conditions during the development of the features can thus be used to constrain the in-situ Earth stresses. One uncertainty for constraining the in-situ stresses are the unknown pressure and temperature conditions which prevailed during the creation of the features (such as breakouts, washouts, and/or drilling-induced tensile fractures). In general, the features could have been created at any time between the bit and a sensor (image, caliper) passing the depth of the feature. Hence, any pressure and temperature condition prevailing during that time could have caused the feature. Compared to wireline runs, while-drilling sensors pass a particular depth a short time after the bit drilled the well, so that the pressure and temperature variations between the bit and the sensor are relatively small. Therefore, the annular pressure and temperature conditions which could have caused a geomechanically relevant feature are significantly constrained (i.e., decreased uncertainty of the pressure and temperature conditions) compared to the wireline case where the sensor passes a particular depth after the entire drilling run. Yet, the analysis of the pressure and temperature history between the bit and a sensor can become complex and not all relevant data are always available at the surface. Therefore, an automated analysis and characterization of the pressure and temperature is essential to constrain the in-situ stresses when features are observed or not observed.

Disclosed next with reference to FIG. 1 is apparatus for implementing the teachings presented below. FIG. 1 illustrates a cross-sectional view of an exemplary embodiment of a downhole tool 10 (also referred to as a bottomhole assembly or BHA) disposed in a borehole 2 penetrating the earth 3, which includes an earth formation 4. The earth formation 4 represents any subsurface material of interest. The downhole tool 10 is conveyed through the borehole 2 by a carrier 5. In the embodiment of FIG.1, the carrier 5 is a drill string 6 in an embodiment referred to as logging-while-drilling (LWD) or measurement-while-drilling (MWD). Disposed at the distal end of the drill string 6 is a drill bit 7. An onshore or offshore drilling rig 8 is configured to conduct drilling operations such as rotating the drill string 6 and thus the drill bit 7 in order to drill the borehole 2. In addition, the drilling rig 8 is configured to pump drilling fluid through the drill string 6 in order to lubricate the drill bit 7 and flush cuttings or cavings from the borehole 2. The drilling rig 8 includes a cavings detector 15 configured to detect borehole wall material that has broken away from the borehole wall and flows to the surface in the drilling fluid. In one or more embodiments, the cavings detector 15 is an optical device such as a video camera installed at the mud shaker to inspect the cavings by image recognition or feature detection methods. Downhole electronics 9 are configured to operate the downhole tool 10, process measurement data (e.g., execute algorithms or record data) obtained by the tool 10, and/or act as a telemetry interface to transmit information to or receive commands from a computer processing system 11 disposed at the surface of the earth 3. The surface computer processing system 11 may also perform operation and/or processing functions in addition to or in lieu of the downhole electronics 9. The downhole tool 10 may operate intermittently, at particular depth intervals, or continuously during the drilling process to provide logging data (i.e., measurement data) for various depths in the borehole 2 and, thus, in the formation 4. In an alternative embodiment, the carrier 5 can be an armored wireline in an embodiment referred to as wireline logging. In wireline logging, the wireline supports the downhole tool 10 and may provide a communications cable for communicating with the computer processing system 11.

The downhole tool 10 is configured to perform various measurements on the formation 4 and on the environment in the borehole 2. One or more pressure sensors 12 and one more temperature sensors 13 are included in the downhole tool 10. With multiple sensors of the same type, the same types of sensors may be separated axially from each other. In addition, these and other sensors may also be disposed in various locations along the drill string 6. In one or more embodiments, the pressure and temperature sensors measure the pressure and temperature of the drilling fluid external to the tool 10 and, thus, provide a measurement of pressure and temperature of the formation 4 at the borehole wall adjacent to these sensors. The downhole tool 10 also includes a borehole wall sensor 14. The borehole wall sensor 14 is configured to sense the borehole wall and detect borehole abnormalities such as a breakout, a washout, or a fracture. The term "breakout" relates to a section of a borehole wall that has wall material removed leaving a pocket or indentation. Commonly, breakouts are created at two sides of the borehole, 180 degrees apart from each other. The term "fracture" related to a crack in the formation, which is visible at the borehole wall. The fracture can be axial along the longitudinal axis of the borehole, circumferential, or diagonal (en-echelon). Embodiments of the borehole wall sensor 14 include a caliper tool configured to measure the diameter of the borehole or an imager configured to produce an image of the borehole wall as the tool 10 is being conveyed through the borehole 2. An imager is a tool designed to measure a physical property in circumferential and axial direction. The physical property may be a gamma ray reading, the formation resistivity, the formation bulk density, or other properties which show sufficient variations for different formation properties. The variations may then be plotted to form an image, which may be displayed.

The downhole tool 10 may also include one or more other sensors (not shown) configured to measure one or more properties related to values that may be input into the geo-mechanical model. For example, the geo-mechanical model may require as inputs formation pore pressure, formation temperature, and formation pressure. The other sensors may provide these and other properties. A formation tester (not shown) having an extendible probe to seal to a wall of the borehole and configured to measure formation pressure or extract a sample of formation fluid for analysis may also be included in the downhole tool 10. In one or more embodiments, these properties may have been previously obtained such as from a nearby borehole or previous analysis, and these other sensors may not be required.

Drilling wells causes the in-situ Earth stresses to redistribute around the borehole. Amongst others, the stress redistribution is affected by the annular pressure applied as a load against the borehole wall and by thermal expansion if the temperature in the formation around the well changes. Both, annular pressures and temperatures vary during the drilling operation.

If the load applied against the borehole wall becomes excessively high and/or the temperature is sufficiently decreased in the formation around the borehole, the minimum principle re-distributed stress becomes tensile, by which fractures are created at the borehole wall. If the load applied against the borehole wall becomes excessively low and/or the temperature is sufficiently increased in the formation around the borehole, the re-distributed shear stress exceeds the rock strength by which parts of the borehole wall break out of the formation, termed breakouts. The observation of breakouts and/or drilling-induced tensile fractures indicates that the annular pressure and/or temperature were excessive, so that the Earth in-situ stresses can be inferred if the additional parameters pore pressure and rock strength are known. This process is termed calibration of the in-situ stresses by observed feature (breakouts and/or drilling-induced tensile fractures).

Figure 3:
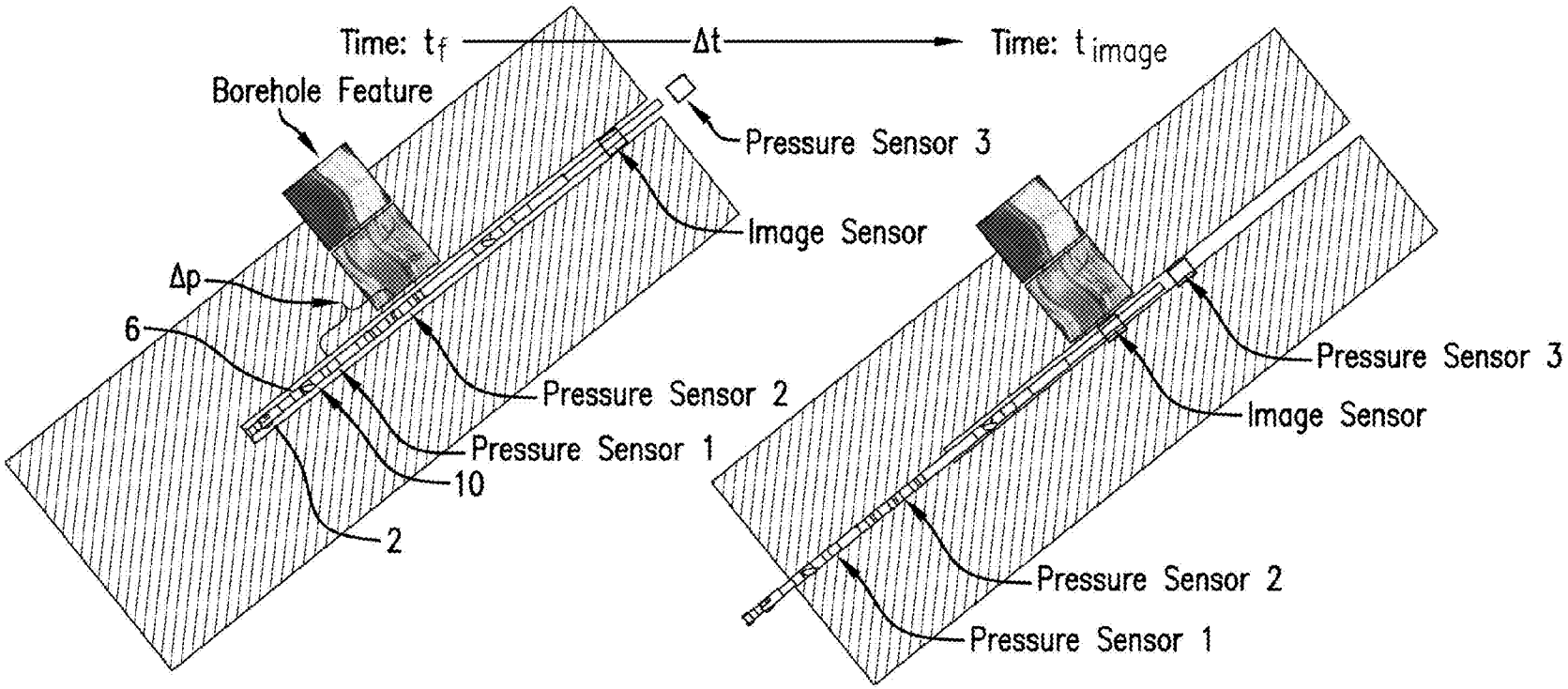
FIG. 3 depicts aspects of the downhole tool passing a formation feature in the borehole.

One uncertainty in the calibration procedure is the unknown pressure and temperature conditions at the time the features were created at the borehole wall, because the time at which the features were created is not known. The time frame for the feature creation is either between two sensors, whenever the first sensor did not show any feature, or between the bit and a sensor passing a specific depth. This uncertainty is illustrated in FIG. 3 showing the creation of a feature at time tf, which is some amount of time after the drill bit has passed the depth where the features were created. In this case, the image sensor is part of the LWD downhole tool, so that while-drilling images can be acquired. However, as the image sensor is a distance away from the drill bit, the image sensor passed the feature depth at time timage, which is after tf.

Another uncertainty that comes along with the determination of the unknown time at which the feature was created is the resulting unknown distance between the feature and a downhole pressure and/or temperature sensor. In one or more embodiments, multiple sensors are contained in the BHA 10, so that a pressure and/or temperature profile can be acquired along the BHA (c.f. FIG. 3). The pressure and/or temperature profile helps to further constrain the annular conditions (i.e., limit the uncertainty of pressure and/or temperature estimates) at the image or caliper sensor location.

One example of uncertainty relates to the development of a pack-off somewhere between pressure sensor 1 or 2 and the image sensor (c.f. FIG. 3). The pack-off would cause a pressure increase which would be observed at the pressure sensor 1 or 2. However, pressure sensor 3 would not see the increased pressure. Now, depending on the depth where a feature (e.g., breakout and/or drilling-induced tensile fracture) was created (either above or below the pack-off), that location is exposed to different pressure values.

Figure 4:
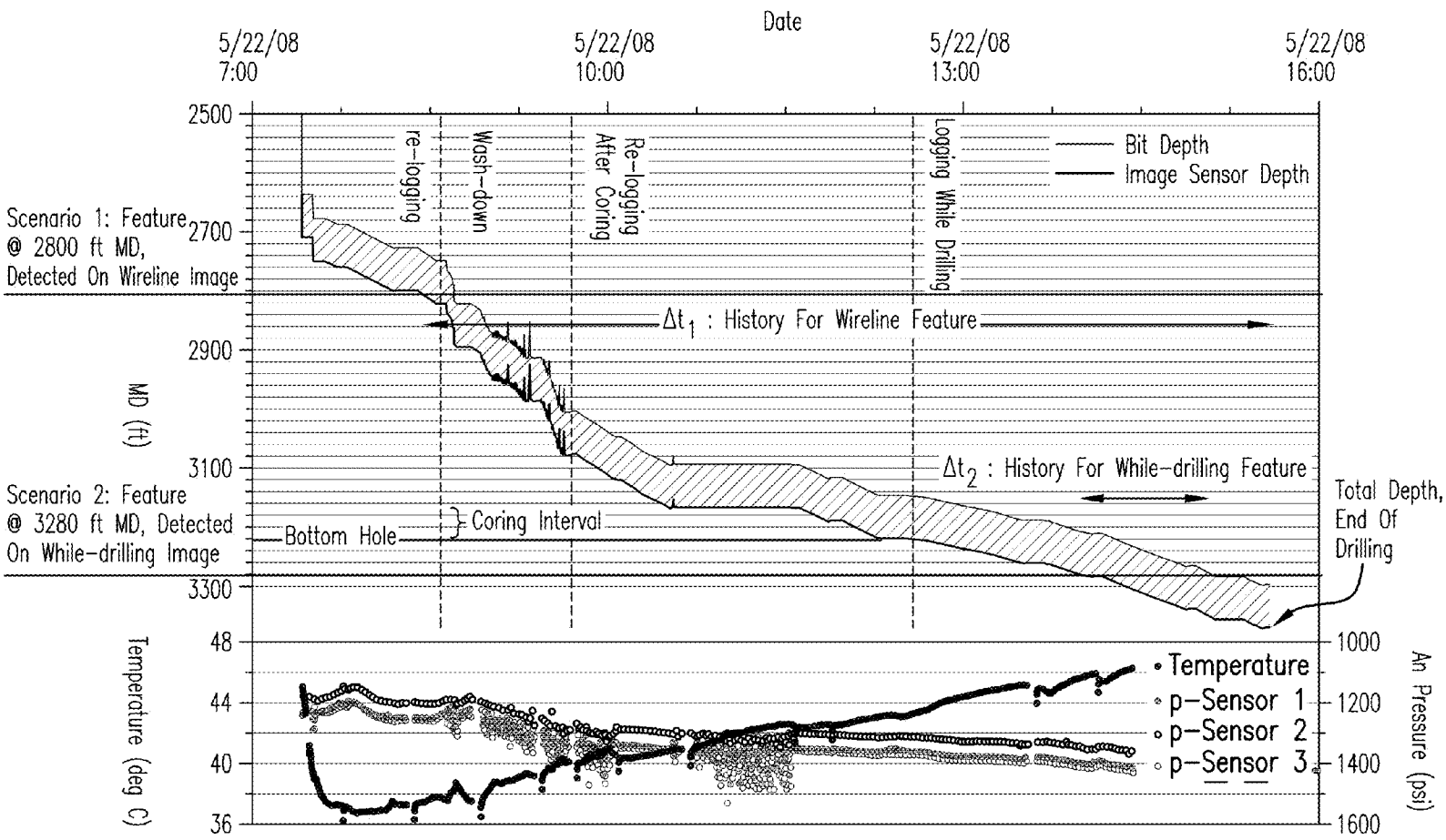
FIG. 4 depicts aspects of detecting a feature and measuring pressure and temperature with a wireline tool and with a while-drilling tool.

The pressure and temperature history between the bit and a sensor detecting a relevant feature (image or acoustic caliper sensor) is shown in FIG. 4 using an example data set. The upper plot shows time and date on the x-axis, and both the measured bit depth (lower graph) and the measured sensor depth (upper graph) on the y-axis. The bottom plot illustrates the acquired downhole annular temperature (left y-axis) and three downhole annular pressure curves (right y-axis) versus the same time and date axis shown on the upper plot. The illustration assumes the drill bit drilled up to the total depth. Two scenarios are considered. Scenario 1 assumes the detection of a feature in a measured bit depth of 2800 ft. MD (measured depth). The feature was detected on a wireline image, which is acquired after the bit reached the total depth and a wireline image service has been run. Consequently, the time interval in which the feature has been created is the time Δt1 plus the time ΔtS (not illustrated) until the image sensor of the wireline service passed the depth of the feature (2800 ft.). As one example for ΔtS, tripping out of hole for the case in FIG. 4 may take until 22:00 on May 22, 2008, and running the wireline log to the depth of a created feature may take until 23:00 on May 22, 2008. ΔtS thus becomes 7 hours, from reaching total depth at around 16:00 on May 22, 2008 until 23:00. Consequently, all pressures and temperatures recorded during that time Δt1 plus the time ΔtS could have caused the feature creation.

Scenario 2 assumes the detection of a feature in a measured bit depth of 3280 ft. MD, but the feature was detected on an image acquired by the while-drilling image sensor, whose current depth versus time is plotted in the upper graph. The time between the bit and the while-drilling sensor passing the feature at 3280 ft. MD is thus Δt2 (termed bit-sensor time interval hereafter), which is significantly shorter than the time Δt1 plus the time ΔtS. Consequently, the range of pressures and temperatures is smaller in scenario 2.

Figure 5A:
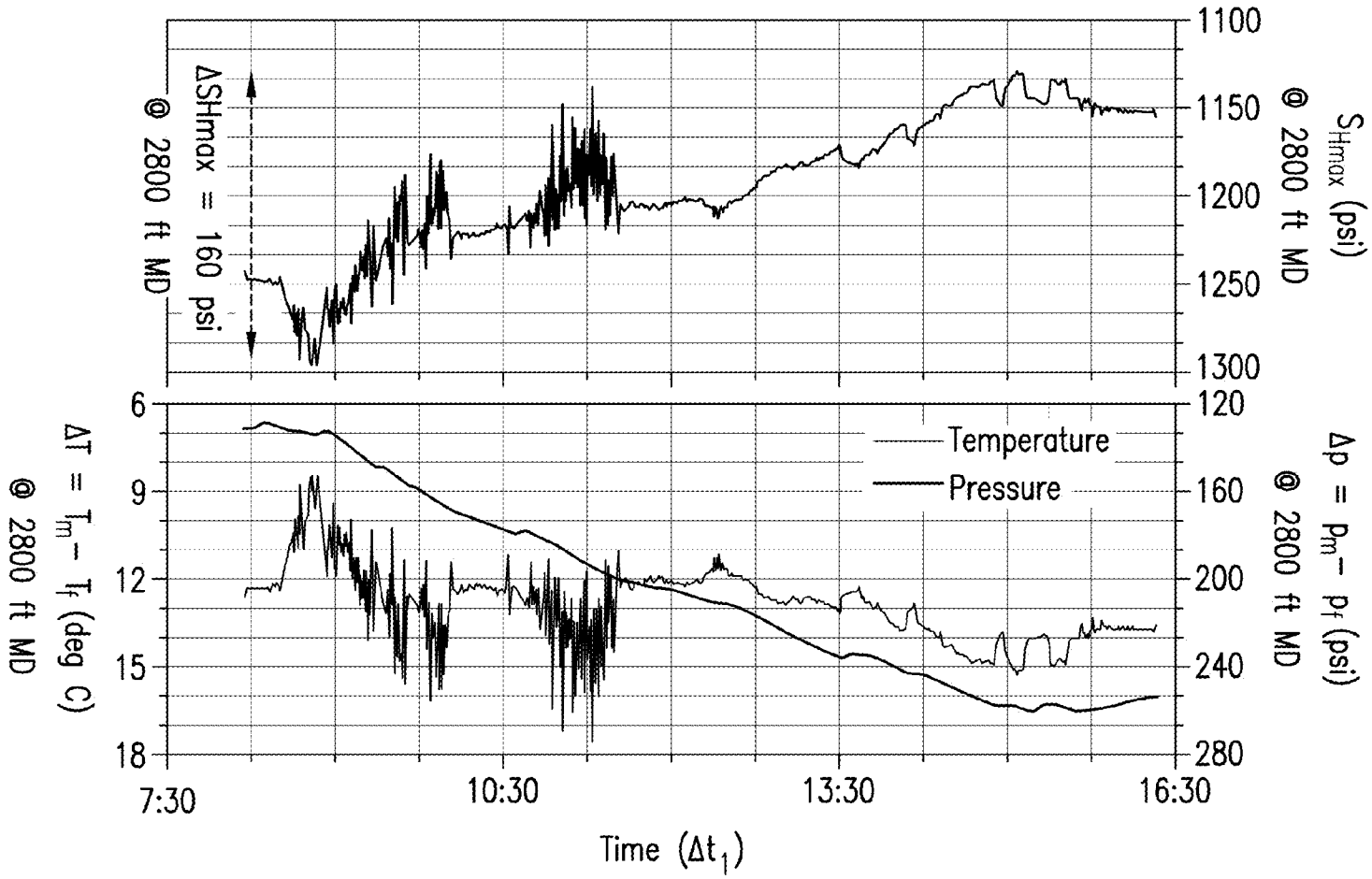
FIGS. 5A and 5B, collectively referred to as FIG. 5, depict aspects of variations in maximum principle horizontal stress and variations in pressure and temperature for the wireline tool and the while-drilling tool.
Figure 5B:
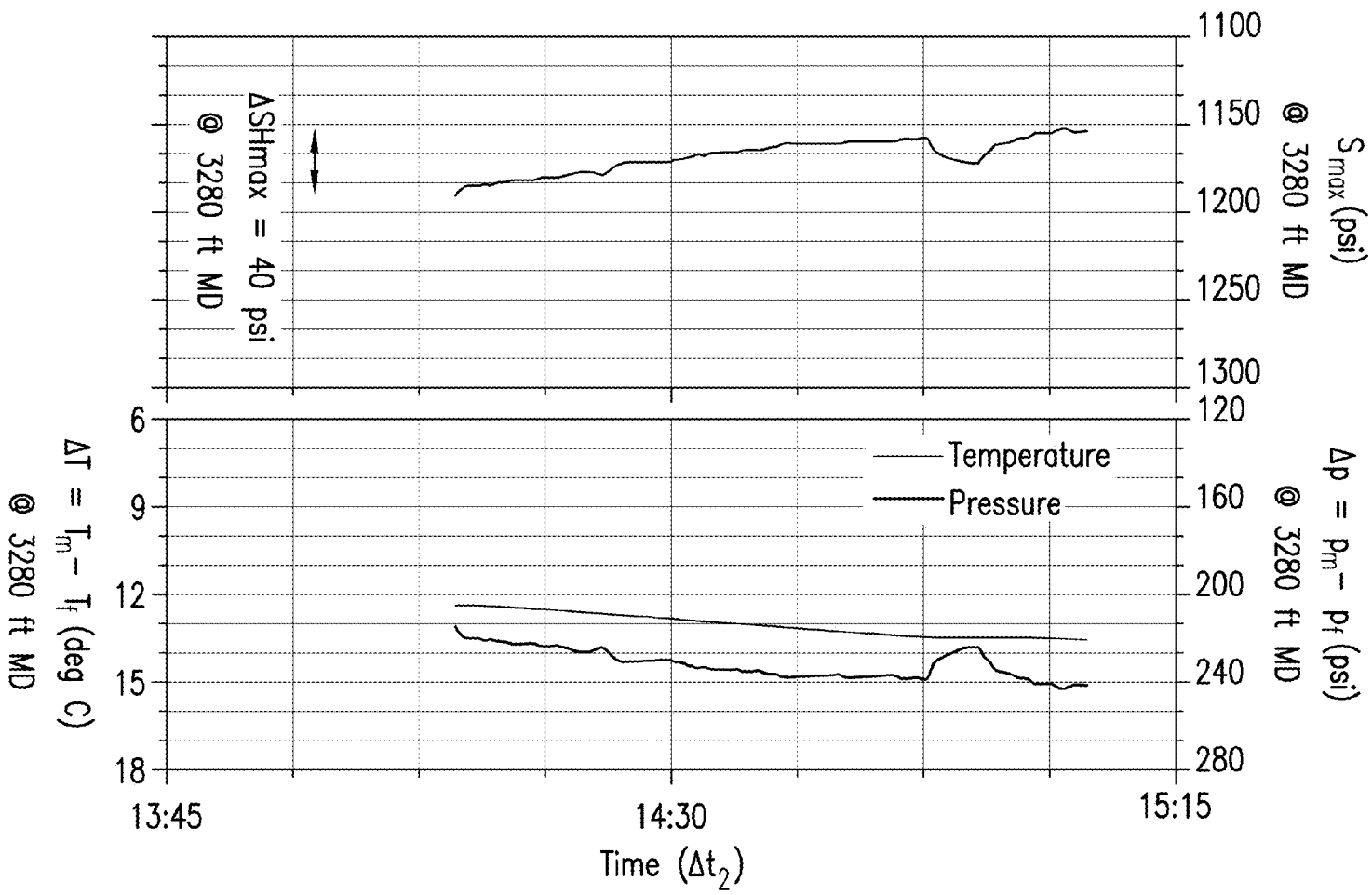
Figure 6A:
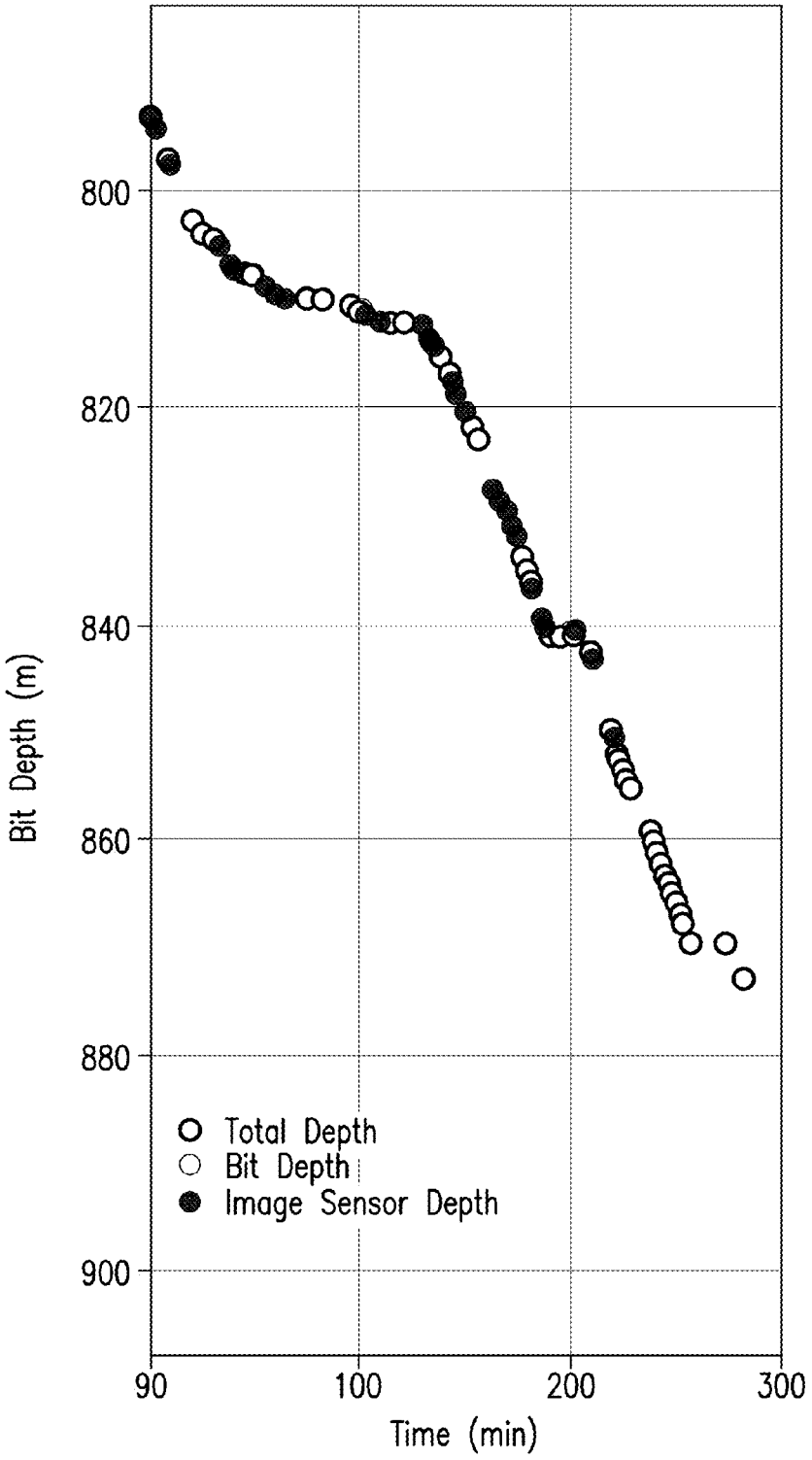
FIGS. 6A-6H, collectively referred to as FIG. 6, illustrate one example of a characterization of pressure history obtained during the bit-to-sensor time interval for the drilling operation.
Figure 6B:
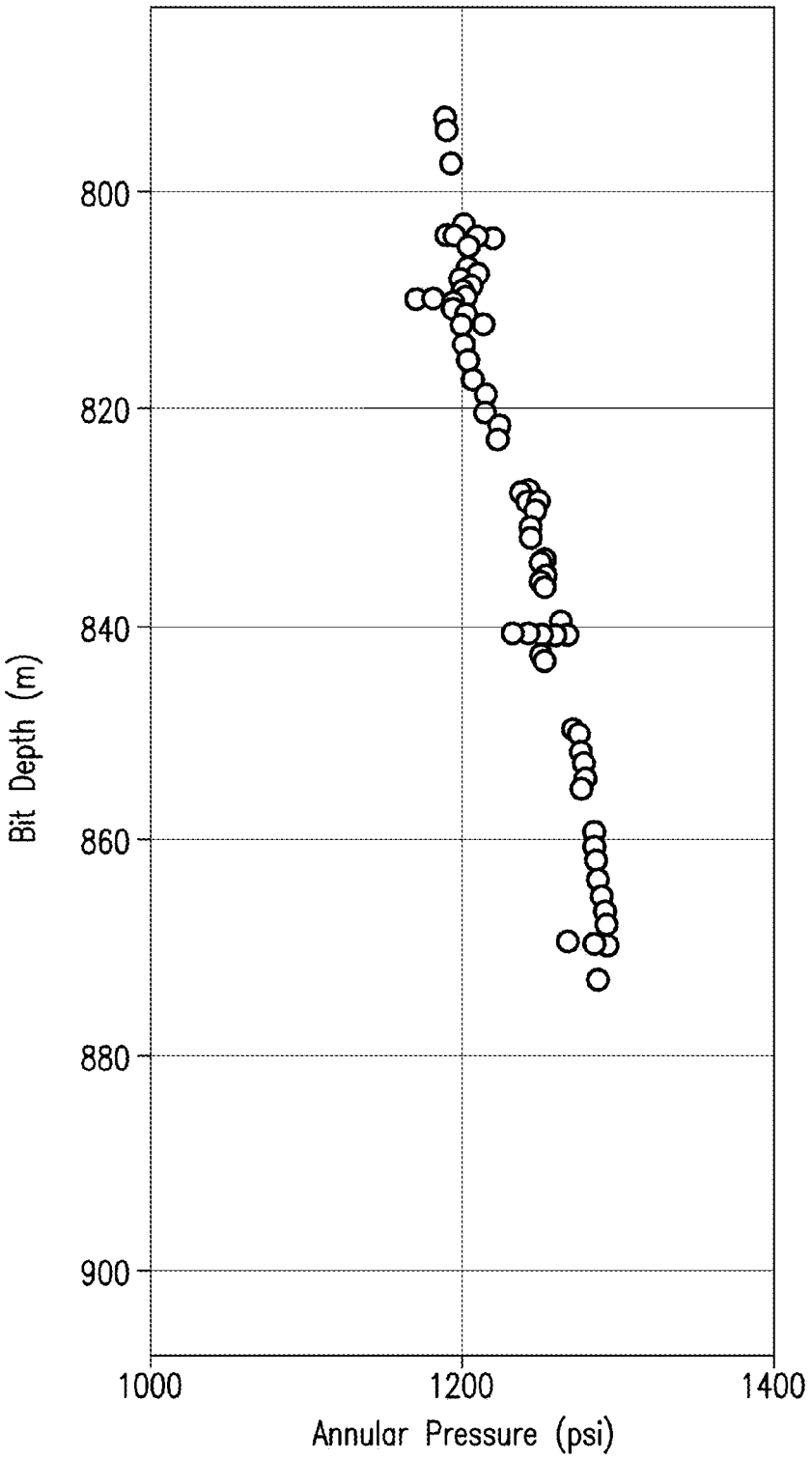
Figure 6C:
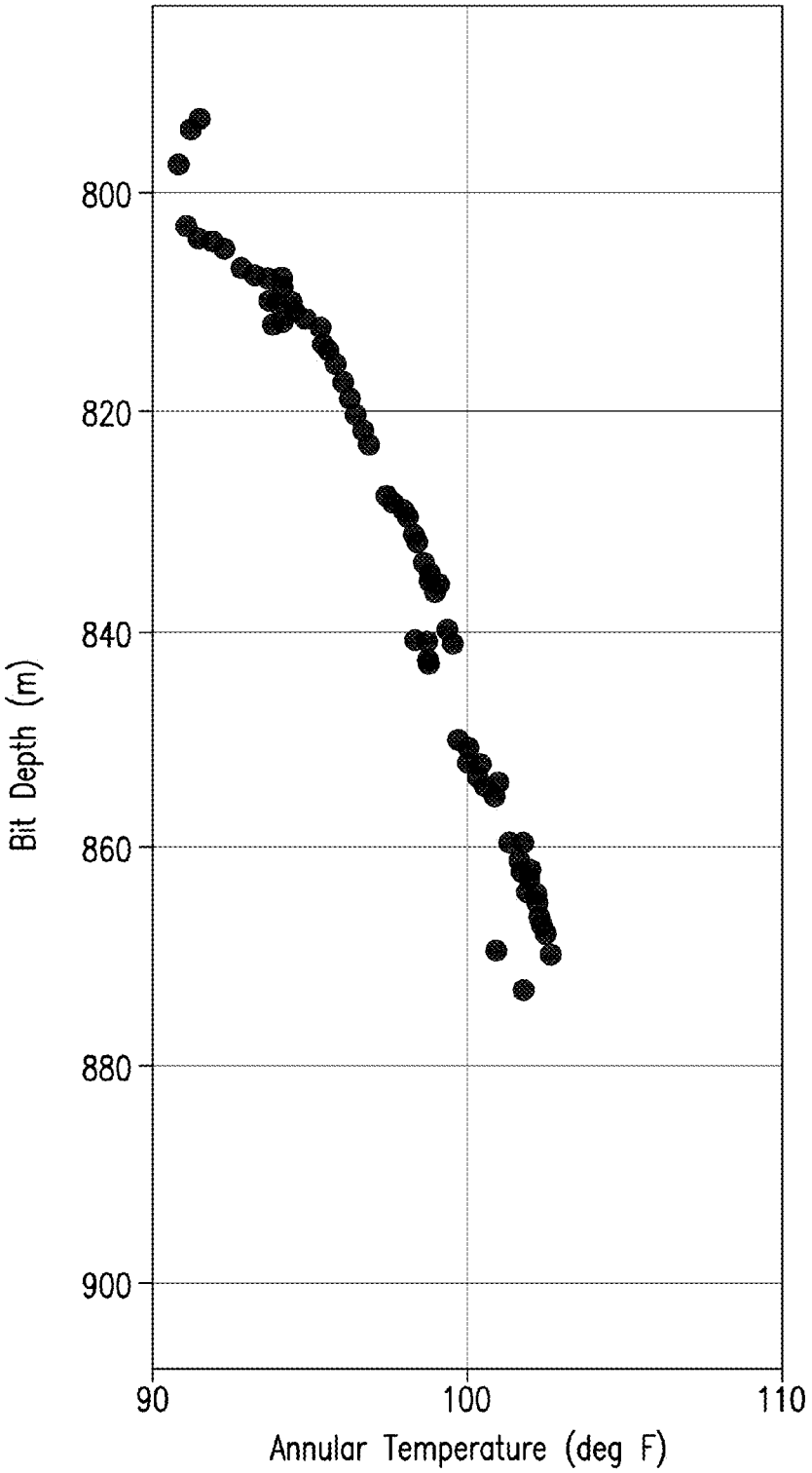
Figure 6D:
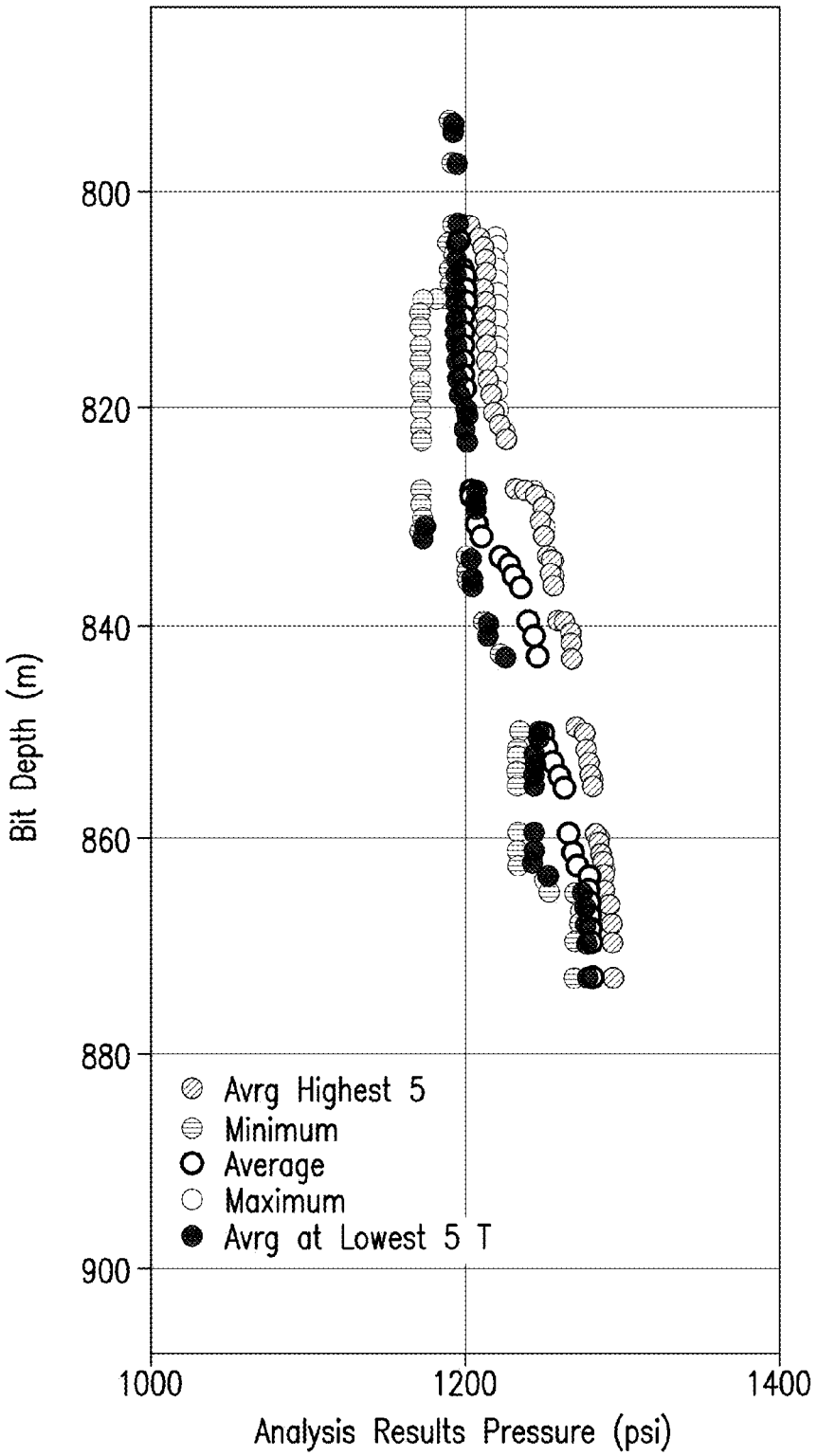
Figure 6E:
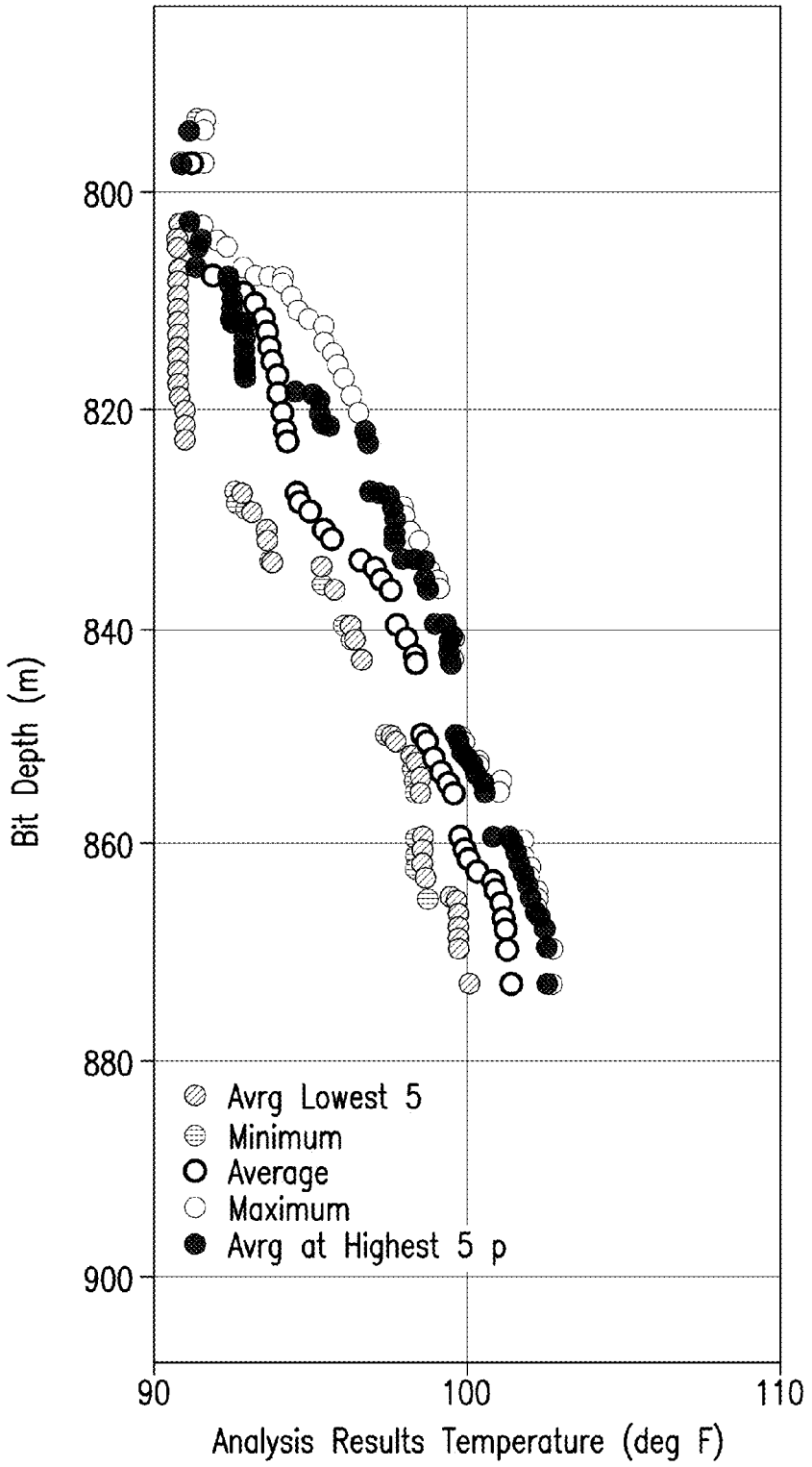
Figure 6F:
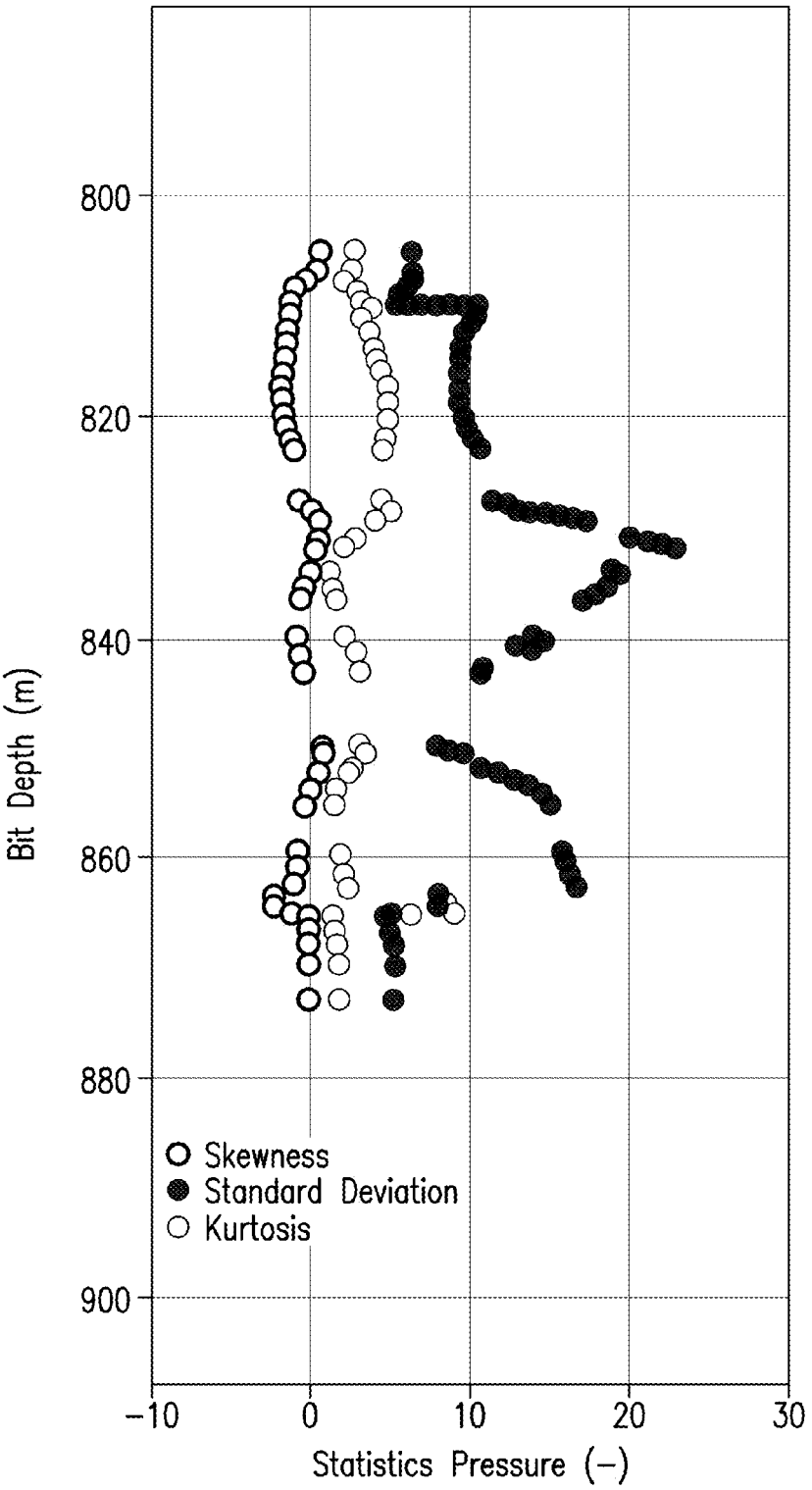
Figure 6G:
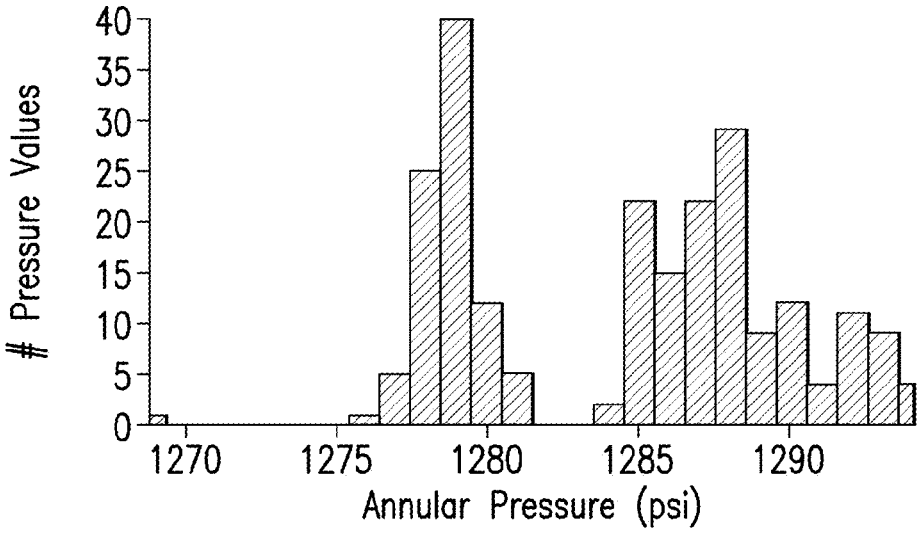
Figure 6H:
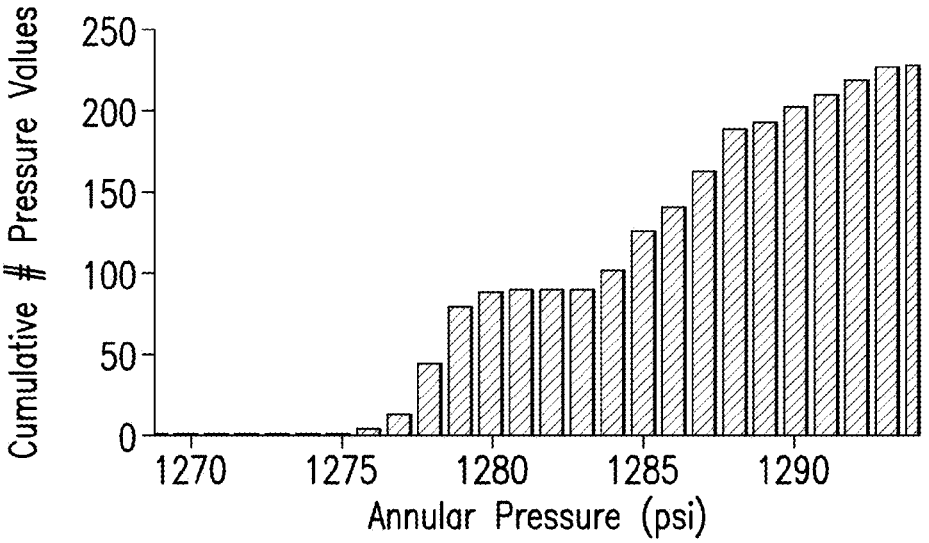

FIGS. 5A and 5B illustrate the determined temperature and pressure variations for scenarios 1 and 2, respectively, as well as the calculated maximum far-field principle horizontal stress SHmax. The data are plotted versus the time Δt1 from FIG. 4. The plotted variations and SHmax are the magnitudes at the depths where the features from the scenarios 1 (2800 ft. MD) and 2 (3280 ft. MD) are presumed (c.f. FIG. 4).

For simplicity, the following assumptions were made for the calculation of SHmax: (1) hydrostatic pore pressure (formation pressure) distribution; (2) temperature equilibrium in the mud (temperature at the bit equals temperature at the image sensor); (3) geothermal gradient of 3° C./100 m; (4) zero tensile rock strength; (5) vertical borehole axis aligned to one of the principle stress directions; and (6) the drilling fluid pressure difference in the annulus along the BHA is hydrostatic. In addition to this, the dynamic pressure effect could be calculated, if the required input parameters are known, to increase the accuracy of this method. With zero tensile rock strength, $\sigma_{\theta\theta}^{min}=0$, and $S_{HMax}=3S_{h\ min}-2p_p-\Delta p-\sigma_{\theta\theta}^{\Delta T}$ and $\sigma_{\theta\theta}^{\Delta T}=(\alpha_T E\Delta T)/(1-\upsilon)$ where: SHMax represents maximum principle horizontal stress; Shmin represents minimum principle horizontal stress; pp represents pore pressure; ΔT represents difference between mud and formation pressure; Δp represents difference between mud and formation pressure; αT represents thermal expansion coefficient; E represents Young's modulus; and υ represents Poisson ratio.

The lower plot in FIG. 5A shows the temperature difference (left axis) between the formation temperature (Tf) and the annulus temperature (Tm) at the depth of 2800 ft. MD. The temperature at the depth of 2800 ft. MD has been calculated by assuming a constant annulus mud temperature between the temperature sensor and the depth of 2800 ft. The formation temperature is assumed to obey a normal temperature gradient of 3° C./100 m. The other curve in the lower plot in FIG. 4A shows the pressure difference between the formation pressure (pf) and the annulus pressure (pm) at the depth of 2800 ft. MD. The pressure at the depth of 2800 ft. MD was calculated by subtracting from the recorded annulus pressure at the pressure sensor depth the hydrostatic pressure difference to the image sensor. In addition to this, the dynamic pressure effect could be calculated, if the required input parameters are known, to increase the accuracy of this method. The upper plot in FIG. 4A shows the calculated SHmax under the assumption that a drilling-induced tensile fracture has been created at the time shown on the x-axis. For example, if a fracture was created at 13:30, the temperature and pressure differences were 14.5° C. and 230 psi, respectively, resulting in a SHmax magnitude of 1175 psi. The range of possible magnitudes of SHmax (DSHmax) within the time Δt1 thus becomes 160 psi.

The lower plot in FIG. 5B shows the temperature difference (left axis) between the formation (temperature Tf) and the annulus (Tm) at the depth of 3280 ft. MD. The other curve in the lower plot in FIG. 5B shows the pressure difference between the formation pressure (pf) and the annulus pressure (pm) at the depth of 3280 ft. MD. The pressure at the depth of 3280 ft. MD was calculated by subtracting from the recorded annulus pressure at the pressure sensor depth the hydrostatic pressure difference to the image sensor. The upper plot in FIG. 5B shows the calculated SHmax under the assumption that a drilling-induced tensile fracture has been created at the time shown on the x-axis. For example, if a fracture was created at 14:30, the temperature and pressure differences were 14° C. and 210 psi, respectively, resulting in a SHmax magnitude of 1175 psi. The range of possible magnitudes of SHmax (DSHmax) within the time Δt2 (while-drilling image) thus becomes 40 psi, which is significantly smaller than in scenario 1 (wireline image).

The extraction of the possible pressure and temperature range from the acquired data can become complex whenever the time delay between the bit and the sensor passing a particular depth becomes large and/or whenever not all data are available at the surface, due to either limited telemetry data transfer band width or due to operational conditions. One such condition is the annular pressure measurement under drilling fluid flow-off conditions at which mud-pulse telemetry does not operate. Therefore, an automatic analysis of the pressure and temperature conditions during the bit-sensor time interval and an appropriate characterization is beneficial in a way that it improves and accelerates the analysis of in-situ Earth stress magnitudes once features such as breakouts and/or drilling-induced tensile fractures were detected at the borehole wall. Automatic feature detection from real-time images is beneficial in this context. Also, such an analysis is essential to consider pressure and temperature uncertainties in the data. An appropriate characterization of the pressure and/or temperature history, for example by maximum and minimum values, allows setting a range of possible values as input data for the analysis.

In one or more embodiments, necessary components for an appropriate analysis include: (1) a downhole sensor which is able to detect any feature which is relevant for geomechanical modeling, such as any image sensor (electrical, density, gamma, acoustic) or a caliper (acoustic caliper or other); (2) at least one downhole sensor which is able to continuously measure the downhole annular pressure and temperature conditions (during drilling fluid flow-on conditions); (3) a downhole sensor which is able to measure the pressure and temperature conditions during a connection (during drilling fluid flow-off conditions) either continuous or discrete; (4) or, alternatively a software system which is able to model downhole conditions based on the physics of the drilling operation and surface measurements; (5) a surface sensor or system which is able to detect wellbore stability relevant features or aspects, such as cavings or gas readings; and (6) a downhole and/or surface software system which is able to analyze and characterize the pressure and temperature variations between the bit and the downhole sensor for feature detection passing a particular depth. Downhole implementation is realized on the downhole electronics of any downhole MWD/LWD tools; surface implementation takes place in the surface computer processing system for data acquisition and analysis.

The teachings disclosed herein aim to automatically characterize the downhole annular pressure and temperature history. "Characterization" includes the statistical or other analysis of the pressure and temperature values for the determination of the maximum, average and minimum temperature and pressure during the bit-sensor time interval, as well as other parameters such as skewness and kurtosis, which describe the asymmetry of the histogram and the peakedness of the pressure values, respectively. Also, an average pressure and temperature value of a few (for example 5 or 10) highest (for pressure) and lowest (for temperature) values are another characterization of the pressure and temperature history. Characterization also includes the identification of the completeness of the data together with the determination of the amount of available data, as well as the identification of data gaps (for example during a connection where flow-off pressure data are not transmitted to the surface), and the determination of the accuracy of the data. In this context of available data, modeling is an additive component to further characterize and constrain the pressure and temperature conditions which were prevailing before an image and/or caliper log passed the depth location. Modeling allows transferring pressure and temperature conditions from the sensor positions to any other location along the BHA. Also, modeling yields pressure and/or temperature values whenever measurements do not exist. Also, characterization includes the consideration of the active operation which prevailed between the bit and the sensor (image or caliper) passing a depth. Operations can be drilling, tripping-out-of-hole, reaming and others. Changes in the drilling parameters (e.g., rate of penetration, weight on bit, and rotational speed) and/or fluid properties (mud weight) help to further characterize the pressure and/or temperature history.

FIG. 6 illustrates one example of a characterization of the pressure history during the bit-sensor time interval at different times during the drilling operation. The analyzed data (including pressure and temperature data) were acquired while-drilling. The upper left plot shows the bit depth (y-axis), the total depth (also on y-axis curve), and the image sensor depth (also on y-axis) versus time. The second and third tracks from the left show the annular pressure and annular temperature, respectively, (x-axis) acquired during the drilling run. The third right track shows the minimum, average and maximum annular pressure determined from all pressure values acquired in the depth interval between the bit and the image sensor. In addition, this track shows an average pressure value of the 5 highest pressures observed during the pressure history, and the average of the 5 pressure values which belong to the lowest five temperatures. The values (minimum, maximum, averages) are plotted to the bit depth. The second track from the right shows the minimum, maximum and average temperatures. Again, averages include the arithmetic average of all temperature values during the bit and the image sensor time, as well as the average of the lowest 5 temperatures and the average of the five pressure values which belong to the five lowest temperatures. The right track shows the skewness, standard deviation and kurtosis of all pressure values acquired in the depth interval between the bit and the image sensor. The two bottom plots show the histograms of all pressure values acquired in the depth interval between the bit and the image sensor. For downhole implementation, the characterization of the pressure/temperature history has the benefit of significantly reducing the amount of information which needs to be transmitted from the downhole tool to the surface. For example, only the maximum, minimum and average pressures within a considered time window may be transmitted instead of the whole pressure data. Finally, the characterization of downhole annular pressure and temperature data is necessary for the determination of uncertainties which need to be assigned to any geomechanical parameters, which are affected by annular pressures and temperatures, such as the magnitudes of in-situ Earth stresses.

Oftentimes, excessively high or low temperature and/or pressure magnitudes are associated with specific drilling operations so that a characterization of features or calibration sources (i.e., measured properties) also includes detecting those drilling operations conducted between the bit and the sensor passing a depth. Relevant operations may be a connection of pipes, tripping into the hole causing a surge effect, tripping out of the hole causing a swab effect, pumping a sweep, changing a mud property such as mud (i.e., drilling fluid) weight, changing the mud flow rate so that the downhole annular pressure is altered, cooling the mud at the surface. In addition, the dynamic behavior of the BHA and/or the drill string, referred to as drilling vibrations, may be responsible for the damage of the borehole wall. Features detected to calibrate the geomechanical model may thus also be attributed by such drilling vibration data.

Figure 7:
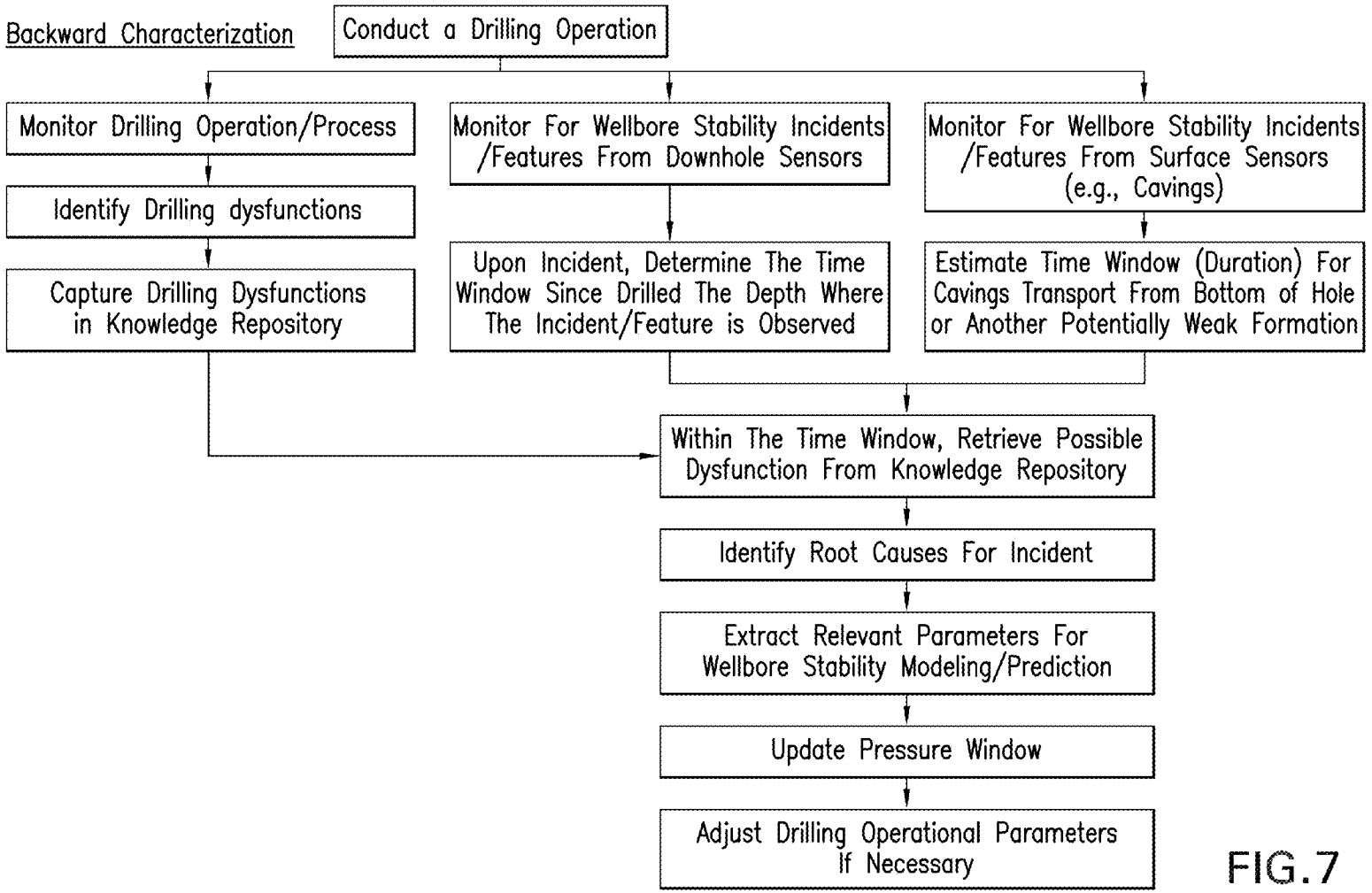
FIG. 7 is a flow chart depicting aspects of a method for backward characterization of a detected feature that can be used for calibration of a geomechanical model.

FIG. 7 illustrates a block diagram related to backward characterization of features that can be used for the calibration of a geomechanical model. Backward characterization is referred to as characterizing features after they have been identified from information or data acquired before the feature was detected, i.e., within the time since drilled. After a feature has been detected, all relevant drilling dynamics events (vibrations of at least a predefined severity), all critical drilling operations are collected and the pressure and temperature history within the time since drilled is characterized. In combination with the analyzed pressure and temperature histories, drilling dynamics events and drilling operations are prioritized according to the likelihood of having caused the creation of the feature or calibration source. After that, the drilling operations, vibrations, pressure and temperature histories and priorities are assigned to the detected feature, and then imported into the geomechanical model. The model is then calibrated based on the imported calibration sources. The calibrated model is then applicable to predict wellbore stability with continuous drilling with current drilling parameters.

Figure 8:
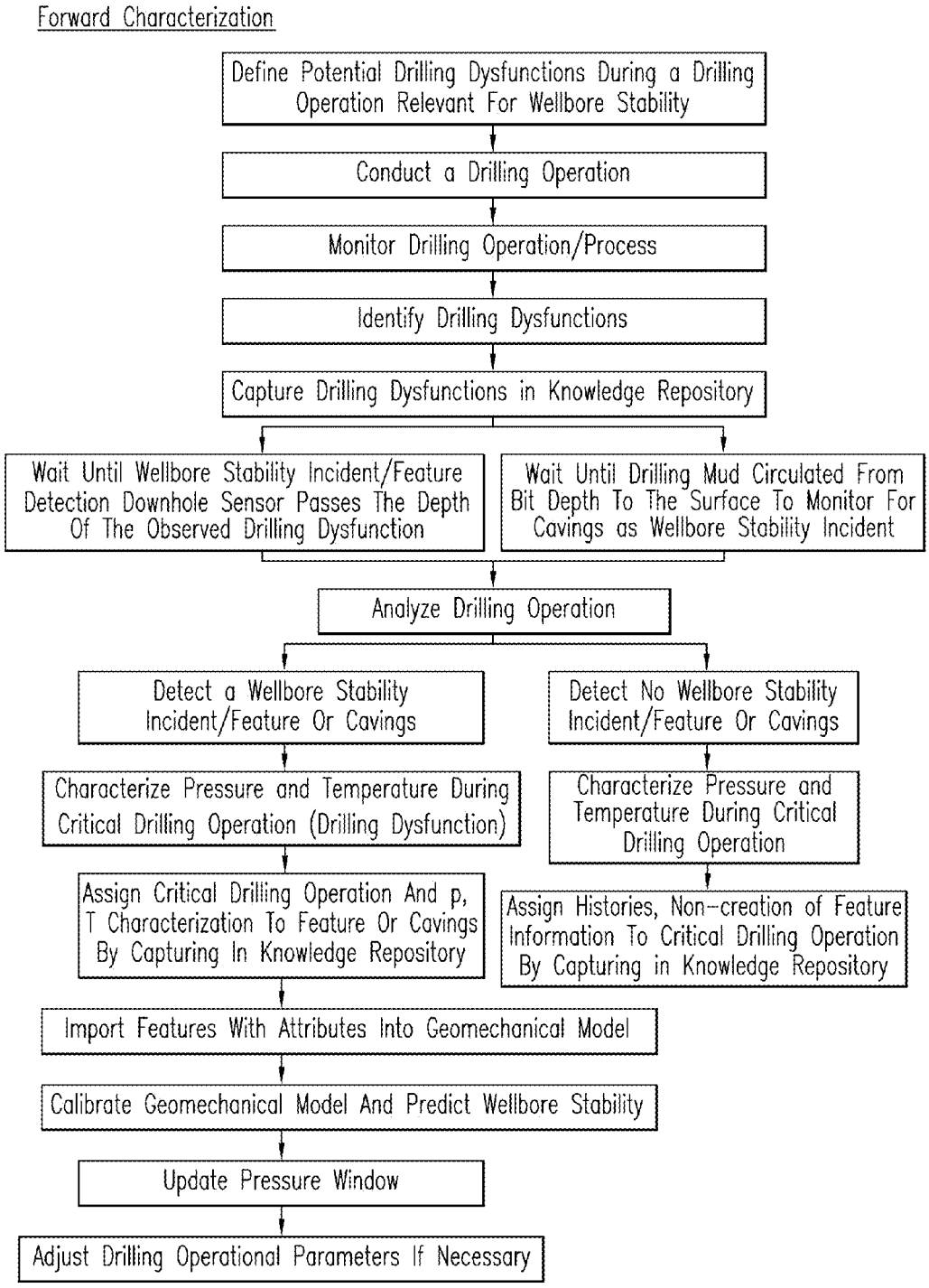
FIG. 8 is a flow chart depicting aspects of a method for forward characterization related to identifying a critical drilling operation, marking a borehole depth at which the operation occurred, determining if the operation caused the occurrence of a feature, and calibrating a geomechanical model based on the forward characterization analysis.

Another way characterization can be performed is by forward characterization, as illustrated in FIG. 8. Forward characterization is referred to as identifying a critical drilling operation, marking the borehole depth at the time the critical drilling operation took place, and waiting until a sensor for feature or calibration source detection has passed the marked borehole depth. If a feature is then detected, the pressure and temperature prevailing during the drilling operation is characterized and, together with the drilling operation, assigned to the detected feature by storing the information into a knowledge repository. The feature is then imported into the geomechanical model for calibration, so that wellbore stability can be predicted. As multiple critical drilling operations may have been prevailing and thus assigned to a detected feature, the drilling operations need to be analyzed and prioritized. In case a feature has not been detected after a critical drilling operation (see right-hand branch of FIG. 8), the pressure and temperature may also be characterized and assigned to the drilling operation.

Figure 9:
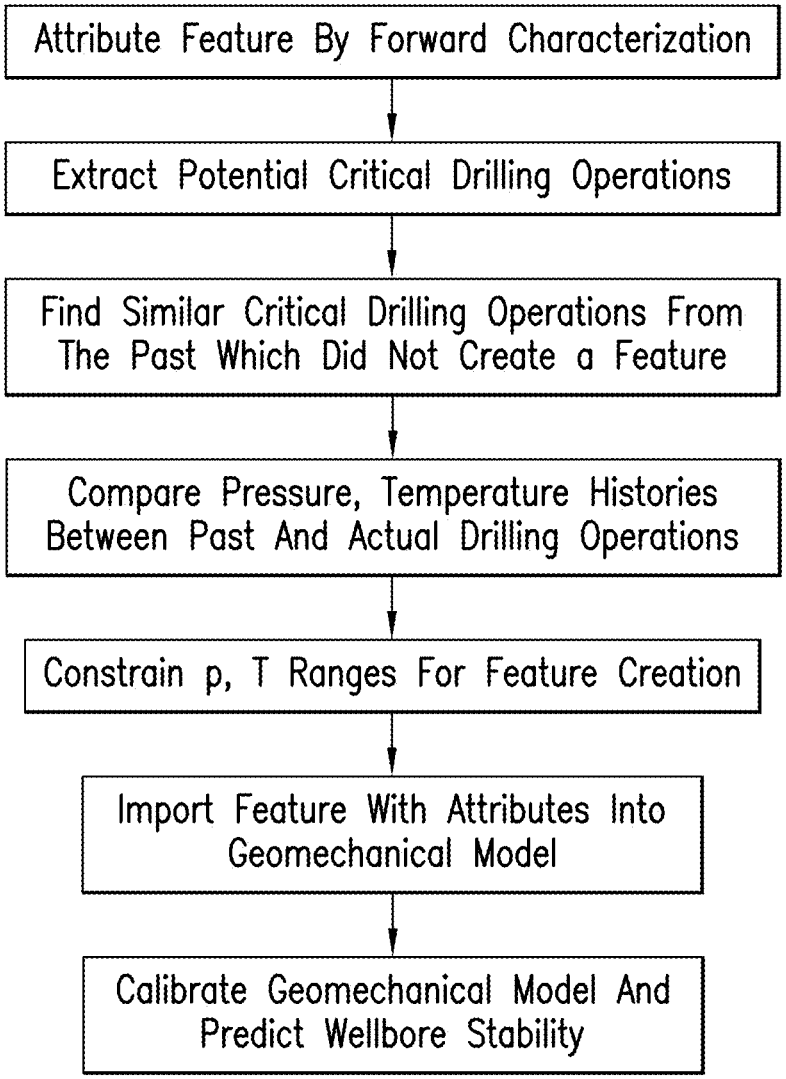
FIG. 9 is a flow chart depicting aspects for a method for calibrating a geomechanical model by comparing critical drilling operations and associated pressures and temperatures that may have or may not have created a feature.

The benefit of forward characterization is illustrated in FIG. 9, which shows a workflow to compare critical drilling events with and without having created a feature for the calibration of a geomechanical model. The comparison of temperature and pressure magnitudes between drilling operations causing or not causing a feature can be used to constrain the safe pressure operating window. The term "pressure operating window" relates to a range of drilling fluid pressures that will not cause the formation stresses calculated in the geomechanical model to be exceeded. A special case is the usage of cavings (i.e., formation material broken out from the borehole wall) for the calibration of the pressure window. If cavings are detected at the surface by mud shakers, which receive and filter the drilling fluid, not only their creation but also the transport time from the weak formation to the shakers is unknown. Workflows as illustrated in FIGS. 7 and 8 may thus be used to characterize cavings for the calibration of a geomechanical model. After cavings have been detected, the duration for cavings transport from the bottom of the borehole (extreme case) or another depth of a pre-defined weak formation may be estimated by modeling or measuring the hydraulic flow properties of the drilling mud which transports the cavings. This time frame is then used to identify the critical drilling operations, drilling vibrations and to characterize the pressure and temperature prevailing within this time.

Figure 10:
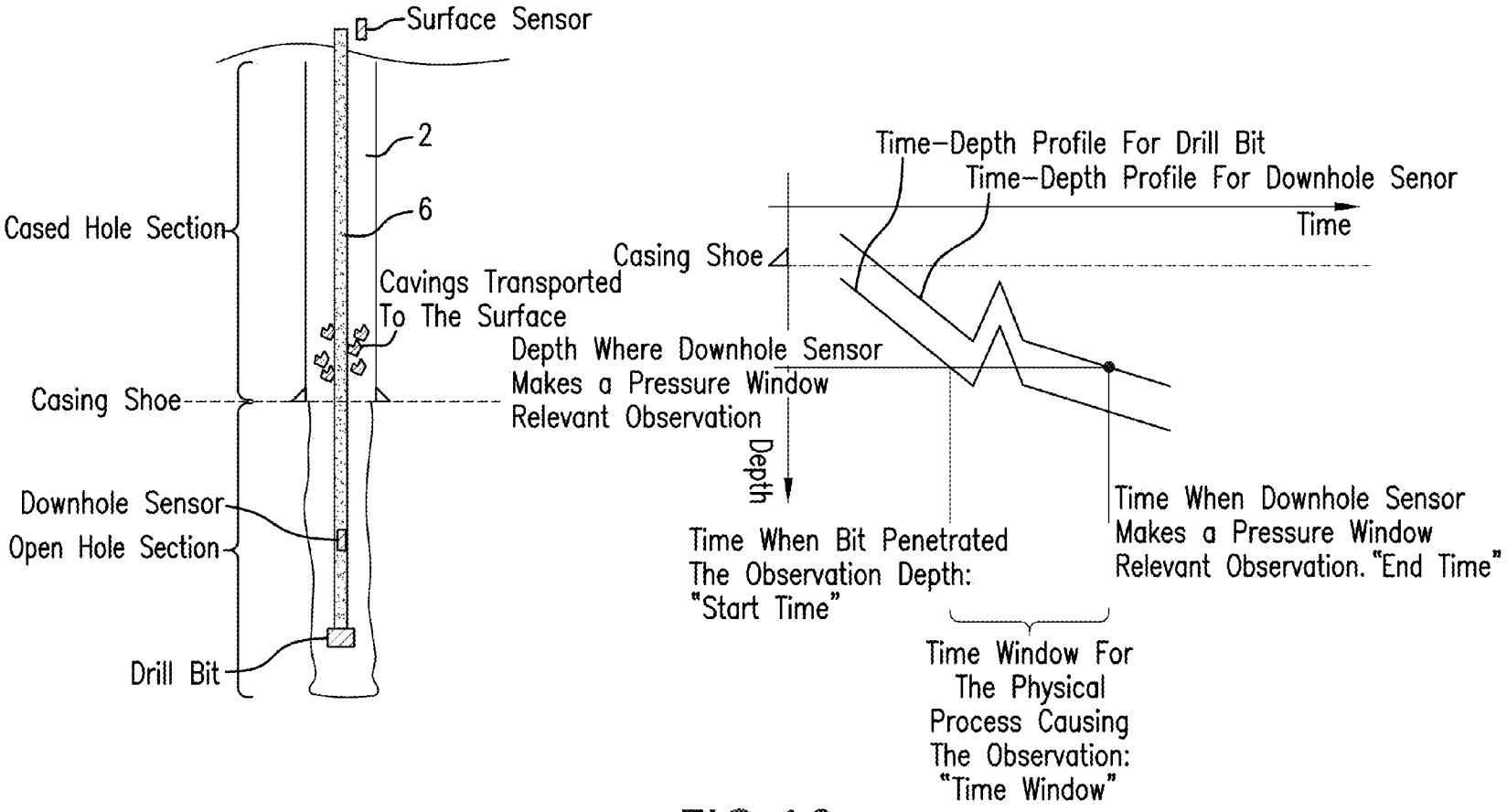
FIGS. 10-12 depict aspects of scenarios for determining the start and end times of a time window for sensors at various locations for detecting a pressure window relevant observation.
Figure 11:
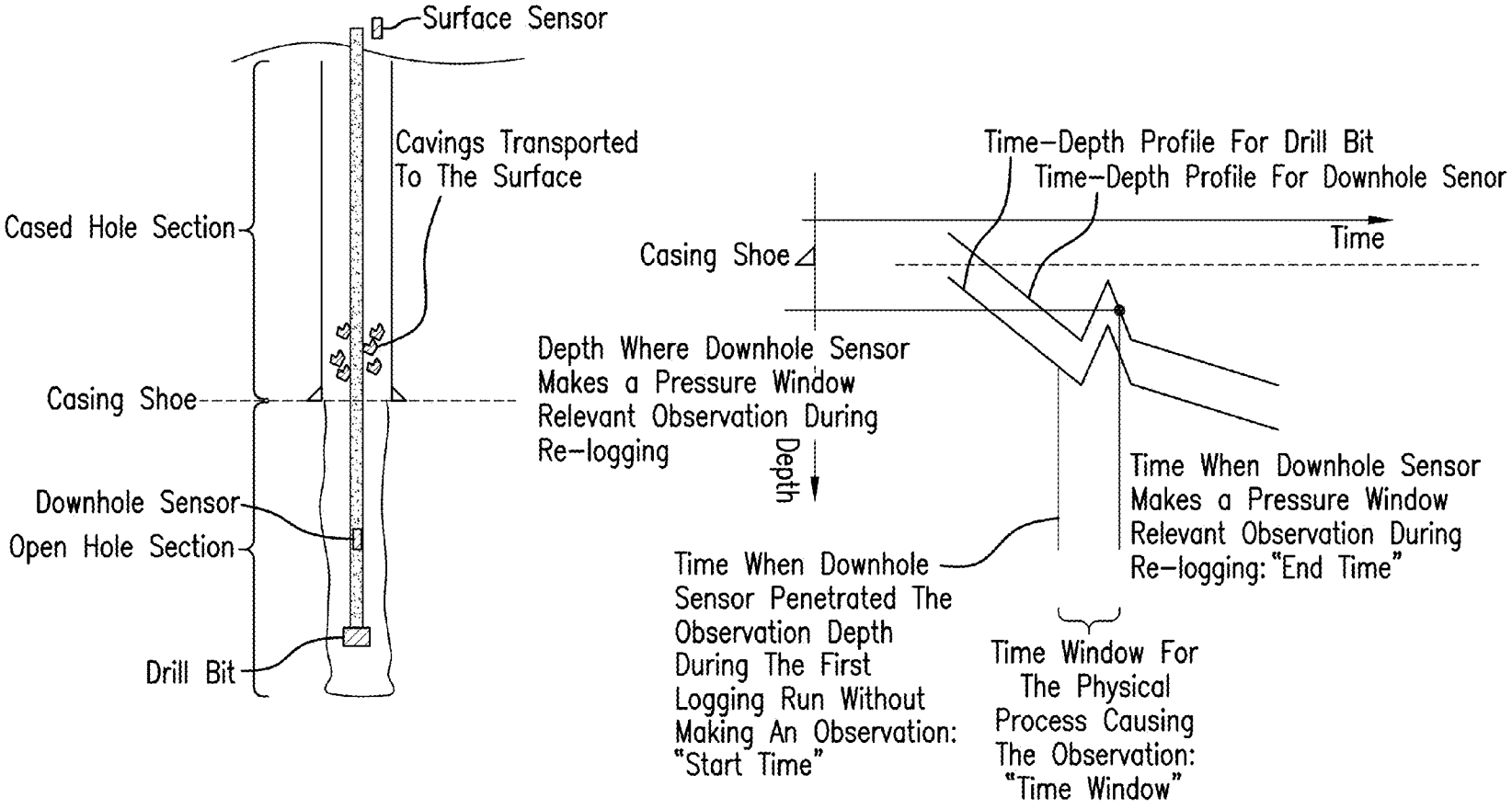
Figure 12:
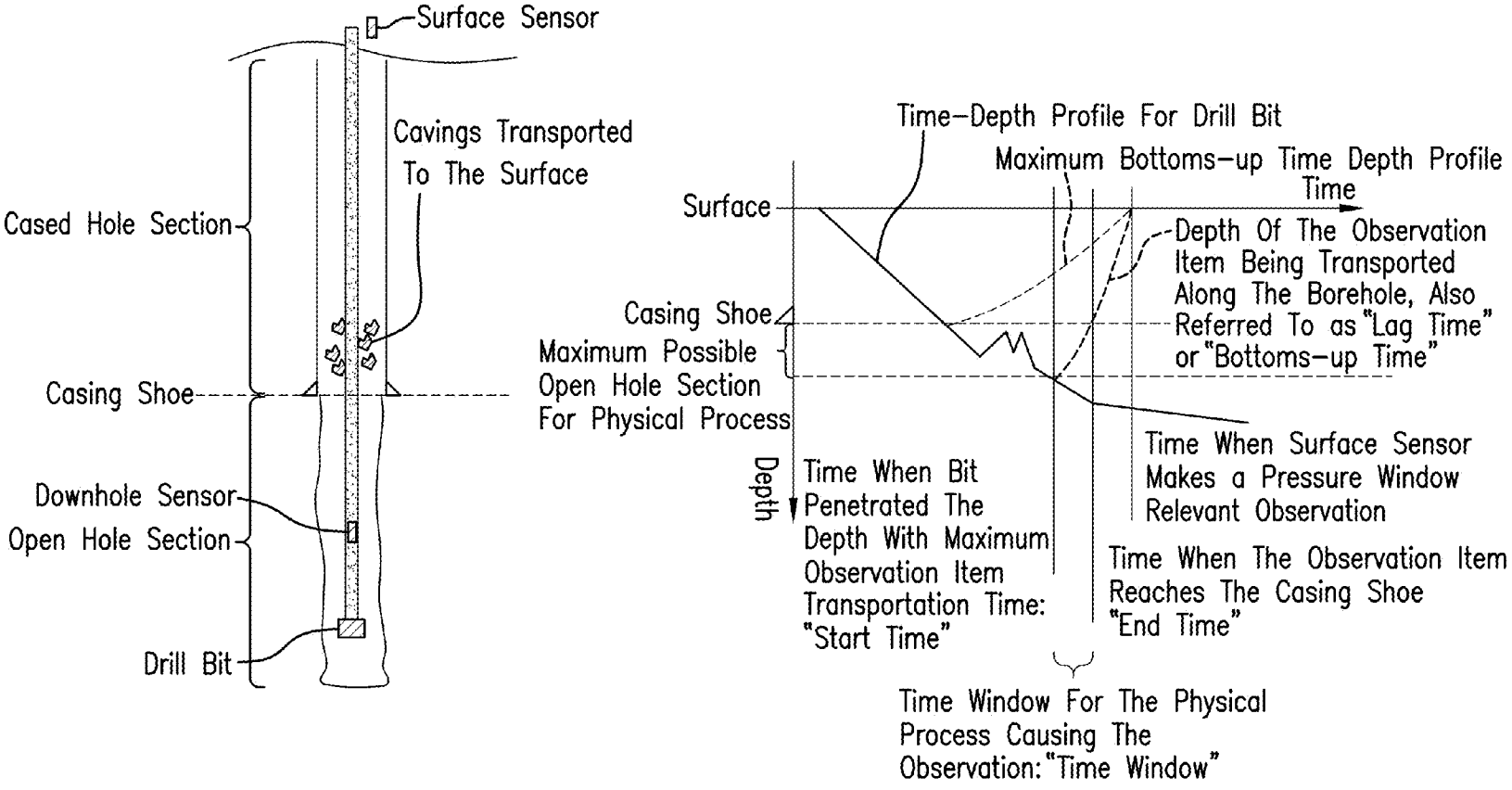
Figure 13A:
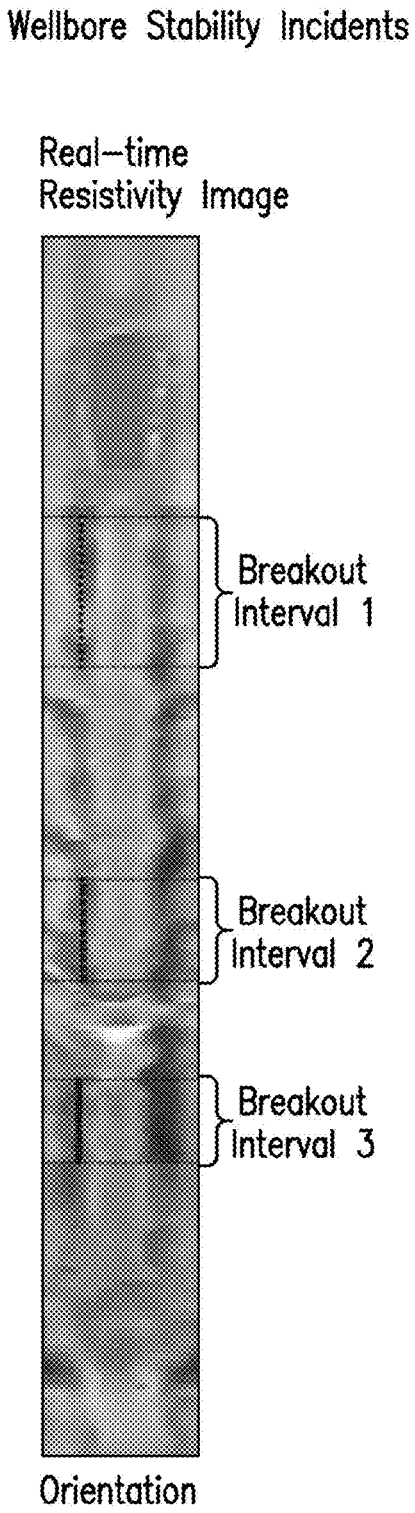
FIGS. 13A-13E, collectively referred to as FIG. 13, are an exemplary display illustrating the detection of a wellbore stability incident.
Figure 13B:
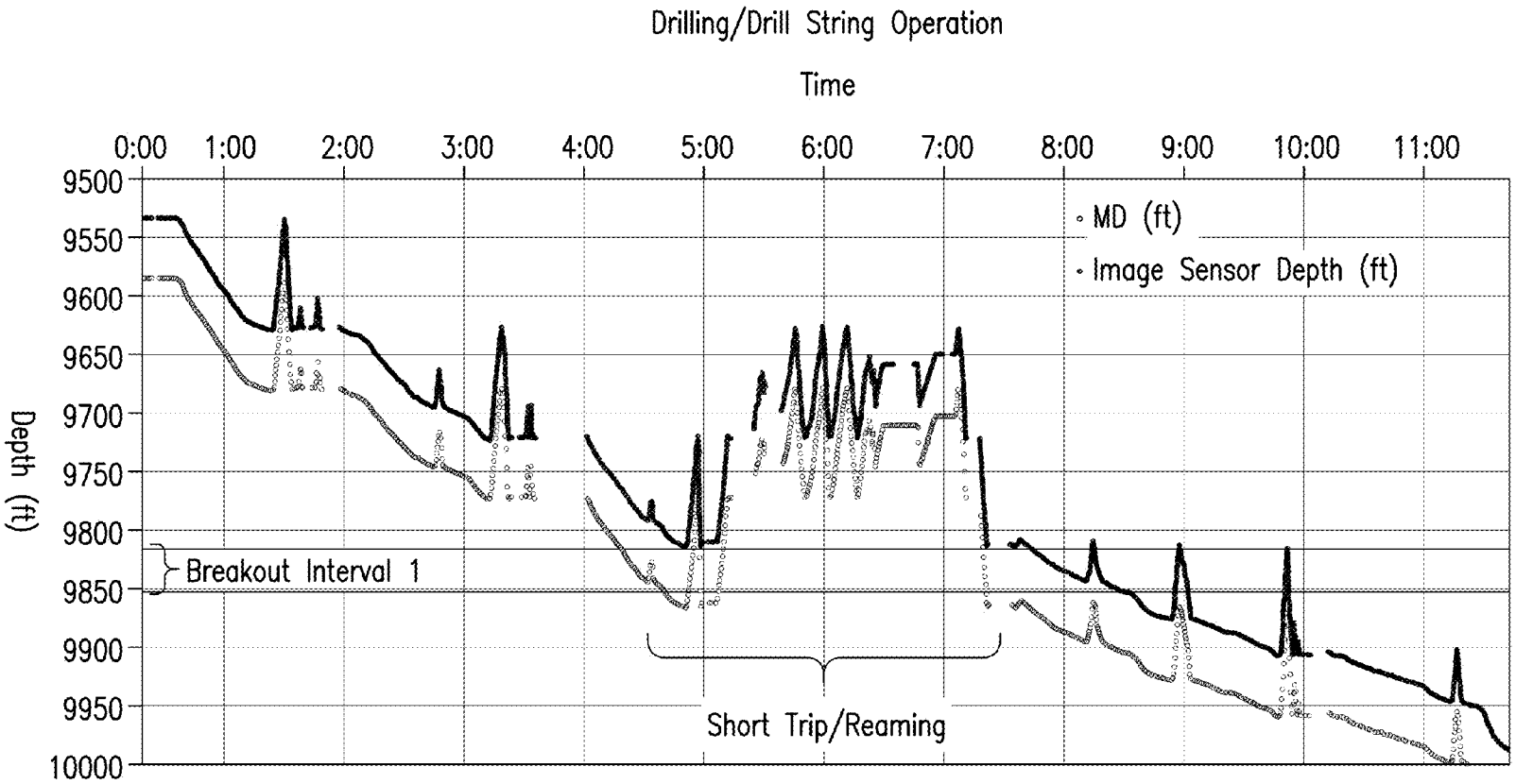
Figures 13C, 13D:
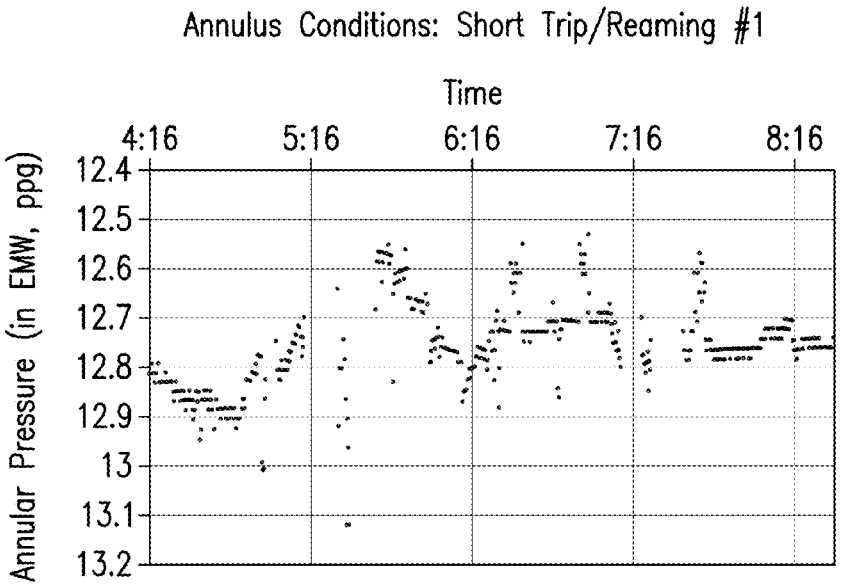
Figure 13E:
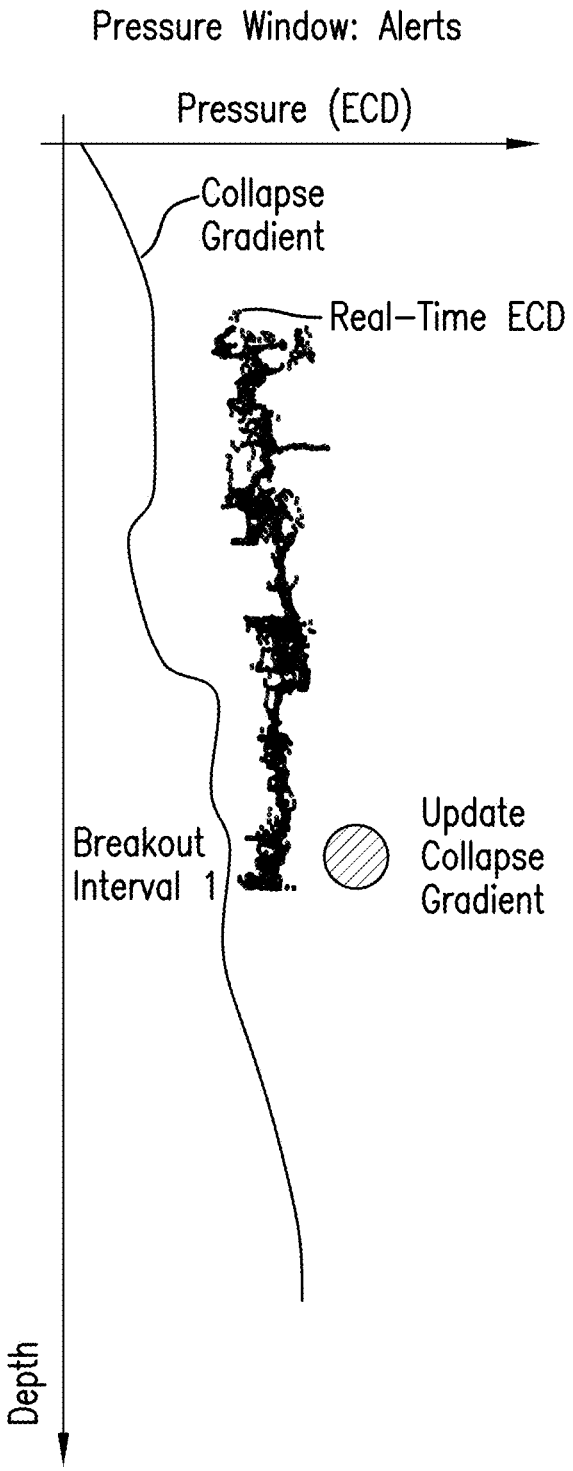

FIGS. 10-12 present scenarios for determining the start and end times of the time window for sensors at various locations for detecting a pressure window relevant observation. A pressure window relevant observation may be an intended event such as a borehole test or an unintended event such as an event not normally expected (e.g., a borehole abnormality). Non-limiting examples of an intended event are formation pressure tests, leak-off tests, extended leak-off tests, formation integrity tests, and borehole influx tests. Unintended events may be borehole abnormalities, which relate to abnormal conditions of the borehole, and/or abnormal drill string behavior, which relates to any behavior of the drill string that indicates a borehole abnormality. For example, a stuck drill string (abnormal drill string behavior) may indicate a collapsed borehole wall (borehole abnormality) that causes the drill string to become stuck downhole. Non-limiting examples of unintended events are breakouts (can be identified e.g. by images, calipers), drilling-induced tensile fractures (can be identified e.g. by images, calipers), washouts (can be identified e.g. by images, calipers), differential sticking (can be identified e.g. by downhole pressure or torque measurements), gas readings (can be identified e.g. by gas sensors—downhole or surface), kicks, losses (can be identified e.g. by monitoring the drilling fluid volume), cavings (can be identified e.g. by cutting analysis), over-pull events (can be identified e.g. by surface hook load measurements), excessive torque, stuck pipe events, and ballooning (can be identified e.g. by downhole pressure measurements or by drilling fluid volume measurements). Drill string vibration (can be identified e.g. by dynamic measurements) is one example of a drill string operation that can cause an unintended event. Drill string vibration in the borehole can cause the drill string to impact a wall of the borehole to dislodge formation material from the wall. Drill string operations, which can cause borehole instability and thus the open borehole event, are not used to adjust the pressure window or calibrate the geo-mechanical model.

Physical parameters, chemical parameters, and/or drill string operations occurring within the time window and at a certain depth in an open borehole may cause an event at that depth in the borehole such as a borehole abnormality or an unexpected event such as gas leakage into the borehole. Non-limiting examples of the physical parameter are borehole pressure in the annulus (i.e., between drill string and borehole wall), differential pressure between the borehole and the formation, and drilling fluid temperature in the annulus. These physical parameters at the certain depth may be input into the geo-mechanical model to determine the formation stresses at that certain depth. If the physical parameters are measured at a distance D from the certain depth, then the parameters at the certain depth may be interpolated from the measured parameters using a hydraulic and/or thermal model. One non-limiting example of a chemical parameter is brine saturation of the drilling fluid, which is used to calculate osmotic effects, effects of water adsorption to clay minerals or rock salt solution effects. Certain obtained physical parameters may be used to adjust the pressure window. These parameters include orientation of borehole breakouts, width of borehole breakouts, shape of drilling-induced tensile fractures, orientation of drilling-induced tensile fractures, and rock strength.

FIG. 10 relates to a downhole while-drilling sensor detecting a pressure window relevant observation and determining a time window in which a process may have occurred to cause the relevant observation. The downhole while-drilling sensor can sense a downhole parameter while drilling is occurring or during a halt in drilling. The left side of FIG. 10 illustrates a cross-sectional view of the borehole 2. The borehole 2 is lined by a casing 100 having a casing shoe 101. The casing shoe 101 delineates the bottom of casing 100. The right side of FIG. 10 illustrates a time-depth profile of the drill bit and downhole sensor illustrated on the left side. In the scenario of FIG. 10, the downhole sensor detects the pressure window relevant observation at what is defined as the "end time." The "start time" is the time when the drill bit penetrated the depth of the observation. Hence, the time the observation occurring is within the time interval, also called the time window, that starts with the time the drill bit penetrated the depth of the observation and ends at the time the observation was detected by the downhole sensor. With the time window known, the various sensed parameters relevant to the pressure window and/or the geo-mechanical model during the time window at that depth can be obtained and used to adjust the pressure window directly or calibrate the geo-mechanical model of the formation and adjust the pressure window according to the calibrated geo-mechanical model to reduce the likelihood of an unintended borehole event from occurring during future drilling.

FIG. 11 relates to a downhole sensor detecting a pressure window relevant observation while re-logging a section of a previously logged borehole and determining a time window in which a process may have occurred to cause the relevant observation. The downhole sensor may be a while-drilling sensor or a sensor disposed at a wireline carrier for wireline logging. The left side of FIG. 11 illustrates a cross-sectional view of the borehole 2 as in FIG. 10. The right side of FIG. 11 illustrates a time-depth profile of the drill bit and downhole sensor illustrated on the left side. In the scenario of FIG. 11, the downhole sensor did not detect the relevant observation while first logging the borehole, but detects the relevant observation at the associated depth during re-logging that depth of the borehole. Therefore, the start time of the time window is the time the downhole sensor passed the depth of the pressure window relevant observation the first time when it was not detected. The end time is the time the downhole sensor detected the relevant observation during the re-logging run.

FIG. 12 relates to a surface sensor, such as a cavings detector, detecting a pressure window relevant observation and determining a time window in which a process may have occurred to cause the relevant observation. The relevant observation relates to borehole material dislodged from the borehole wall and being transported to the surface with the drilling fluid where the material is detected. The left side of FIG. 11 illustrates a cross-sectional view of the borehole 2 as in FIGS. 10 and 11. The right side of FIG. 12 illustrates a time-depth profile of the drill bit and the borehole material transportation profile showing the range of depths that the borehole material may be at where it was dislodged. In the scenario of FIG. 12, the surface sensor detects the pressure window relevant observation at the surface. The transportation time is accounted for and is not included in the time window. However the transportation time can vary depending on the depth the dislodging of the borehole material. It is noted that the minimum depth at which the borehole material can be dislodged is the depth of the casing shoe, while the maximum depth of the dislodging of the material is the depth of the maximum possible open-hole section that a physical process could have occurred at to cause the dislodging. The start time of the time window is set as the intersection of the time-depth profile of the drill bit and the transportation depth profile. The end time of the time window is set as the intersection of the depth of the casing shoe and the transportation depth profile. It is noted that the transportation depth profile may, the extreme case, intersect the time-depth profile of the drill bit at the depth of the casing shoe and, in that case, the time window is a maximum.

FIG. 13 is an exemplary graphic display, which may be displayed on a monitor, illustrating the detection of a wellbore stability incident (breakouts in this case). The display includes the drill or drill string operations conducted until the breakout was detected (center upper plot), an overview of the downhole annulus conditions (lower left center plot), the relevant parameters to calibrate the pressure window (lower right center plot), and the pressure window and real-time ECD with alarms and advice.

It can be appreciated that one or more advantages of the methods and apparatus disclosed above relate to drilling a borehole efficiently using drilling parameters that may aggressively drill the borehole while at the same time being conservative to prevent a borehole abnormality from occurring.

In support of the teachings herein, various analysis components may be used, including a digital and/or an analog system. For example, the downhole electronics 9, the computer processing system 11, or the sensors in the downhole tool 10 may include digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

The term "carrier" as used herein means any device, device component, combination of devices, media and/or member that may be used to convey, house, support or otherwise facilitate the use of another device, device component, combination of devices, media and/or member. Other exemplary non-limiting carriers include drill strings of the coiled tube type, of the jointed pipe type and any combination or portion thereof. Other carrier examples include casing pipes, wirelines, wireline sondes, slickline sondes, drop shots, bottom-hole-assemblies, drill string inserts, modules, internal housings and substrate portions thereof.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first" and "second" are used to distinguish elements and do not denote a particular order. The term "coupled" relates to a first component being coupled to a second component either directly or indirectly through an intermediate component.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for estimating a time at which a pressure window relevant observation occurred relating to an event that occurred in an open borehole penetrating an earth formation, the method comprising:

drilling with a drill string a borehole penetrating the earth formation, the drill string comprising a drill bit and a downhole tool;

receiving with a processor a pressure window relevant observation that occurs during a drilling or logging operation and that provides input to adjusting a pressure window for drilling fluid for drilling the borehole;

determining a history comprising a time series of measurements of at least one of a physical parameter and a chemical parameter during a time when the drill bit penetrated a location where the event occurred and a time when the pressure window relevant observation was made;

estimating with the processor a time window in which the event occurred from:

the time when a drill bit penetrated a location where the event occurred;

the time when the pressure window relevant observation was made; and at least one selection from a group consisting of the physical parameter, the chemical parameter; and a process that caused the event to occur, the time window having a start time and an end time;

characterizing the at least one selection by using the at least one of a physical parameter and a chemical parameter to generate a calibration parameter;

adjusting a pressure window to provide an adjusted pressure window for drilling the borehole with a drilling rig using the calibration parameter, wherein the adjusted pressure window reduces the likelihood of an unintended borehole event; and drilling the borehole into the earth formation with the drilling rig using the adjusted pressure window, wherein the drilling rig generates drilling fluid pressure in accordance with the adjusted pressure window to provide a range of drilling pressures that reduces the likelihood of an unintended borehole event.

2. The method according to claim 1, wherein the pressure window relevant observation comprises at least one selection from a group consisting of a borehole abnormality and a drill string behavior.

3. The method according to claim 2, wherein the borehole abnormality comprises at least one selection from a group consisting of a borehole breakout, a borehole washout, borehole cavings detection, drilling-induced tensile fracture, hydrocarbon gas detection, a kick, drilling fluid losses, and ballooning.

4. The method according to claim 2, wherein the drill string operation comprises at least one selection from a group consisting of differential sticking, over-pull events, excessive torque, and a stuck drill pipe event.

5. The method according to claim 1, wherein the physical parameter comprises at least one selection from a group consisting of pressure and temperature.

6. The method according to claim 1, wherein the chemical parameter comprises brine saturation used to calculate at least one selection from a group consisting of an osmotic effect, a water adsorption effect, and a salt solution effect.

7. The method according to claim 1, wherein the process comprises at least one selection from a group consisting of a test conducted in the borehole and a drill string operation.

8. The method according to claim 7, wherein the drill string behavior comprises vibrations of the drill string.

9. The method according to claim 8, further comprising not adjusting the pressure window when the drill string vibrations occur within the time window and exceed a threshold.

10. The method according to claim 1, further comprising adjusting the pressure window using data obtained within the time window in order to reduce the likelihood of a borehole abnormality from occurring.

11. The method according to claim 10, further comprising calibrating a geo-mechanical model of the earth formation using data obtained within the time window, the data comprising at least one selection from a group consisting of downhole annulus pressure data and downhole temperature data, and adjusting the pressure window using the calibrated geo-mechanical model.

12. The method according to claim 10, wherein the data is obtained by a downhole sensor.

13. The method according to claim 12, wherein the data comprises at least one selection from a group consisting of annulus pressure data and temperature data.

14. The method according to claim 1, further comprising detecting the pressure window relevant observation with a sensor, the sensor comprising at least one selection from a group consisting of (a) a downhole sensor configured to be conveyed through the borehole and for at least one of while-drilling sensing and re-logging a previously logged borehole and (b) a surface sensor.

15. The method according to claim 1, further comprising performing a statistical analysis on at least one type of data obtained within the time window to provide a representative value of the at least one type of data.

16. The method according to claim 15, wherein the at least one type of data comprises at least one selection from a group consisting of downhole annulus pressure data and downhole temperature data.

17. The method according to claim 15, further comprising displaying the representative value, the pressure window relevant observation, drilling operations within the time window, measured parameters within the time window, and the pressure window to a user using a display.

18. The method according to claim 1, interpolating at least one selection from a group consisting of the physical parameter and the chemical parameter that was obtained a distance D from a depth of the event in the borehole to provide an interpolated parameter at the depth.

19. An apparatus for estimating a time at which a pressure window relevant observation occurred relating to an event that occurred in an open borehole penetrating an earth formation, the apparatus comprising:

a drill string configured to drill a borehole penetrating the earth formation, the drill string comprising a drill bit and a downhole tool;

a processor configured to:

receive a pressure window relevant observation that occurs during a drilling or logging operation and that provides input to adjusting a pressure window for drilling fluid for drilling the borehole;

determine a history comprising a time series of measurements of at least one of a physical parameter and a chemical parameter during a time when the drill bit penetrated a location where the event occurred and a time when the pressure window relevant observation was made;

estimate a time window in which the event occurred from:

the time when a drill bit penetrated a location where the event occurred and the time when the pressure window relevant observation was made;

at least one selection from a group consisting of the physical parameter, the chemical parameter; and a process that caused the event to occur, the time window having a start time and an end time;

characterize the at least one selection by using the at least one of a physical parameter and a chemical parameter to generate a calibration parameter;

adjust a pressure window to provide an adjusted pressure window for drilling the borehole with the drilling rig using the calibration parameter, wherein the adjusted pressure window reduces the likelihood of an unintended borehole event;

a drilling rig configured to drill the borehole into the earth formation using the adjusted pressure window, wherein the drilling rig generates drilling fluid pressure in accordance with the adjusted pressure window to provide a range of drilling pressures that reduces the likelihood of an unintended borehole event.

20. The apparatus according to claim 19, further comprising a sensor coupled to the processor and configured to sense the pressure window relevant observation.

21. The apparatus according to claim 20, further comprising a carrier configured to convey the sensor through the borehole.

22. The apparatus according to claim 19, wherein the processor is further configured to adjust the pressure window using data obtained within the time window in order to reduce the likelihood of a borehole abnormality from occurring.

23. The apparatus according to claim 22, wherein the processor is further configured to calibrate a geo-mechanical model of the earth formation and to adjust the pressure window using the calibrated geo-mechanical model.

24. The apparatus according to claim 19, wherein the processor is further configured to (a) perform a statistical analysis on at least one type of data obtained within the time window to provide a representative value of the at least one type of data and (b) display the representative value to a user using a display.

* * * * *